US012121958B2

(12) United States Patent
Aizawa et al.

(10) Patent No.: US 12,121,958 B2
(45) Date of Patent: Oct. 22, 2024

(54) CENTRIFUGAL CASTING MOLD AND CENTRIFUGAL CASTING MOLD ASSEMBLY DEVICE

(71) Applicants: TPR CO., LTD., Tokyo (JP); TPR INDUSTRY CO., LTD., Sagae (JP)

(72) Inventors: Hideki Aizawa, Sagae (JP); Shin Moriyama, Sagae (JP); Mizuki Yamashita, Sagae (JP)

(73) Assignees: TPR CO., LTD., Tokyo (JP); TPR INDUSTRY CO., LTD., Sagae (JP)

( * ) Notice: Subject to any disclaimer, the term of this patent is extended or adjusted under 35 U.S.C. 154(b) by 0 days.

(21) Appl. No.: 18/258,748

(22) PCT Filed: Dec. 21, 2020

(86) PCT No.: PCT/JP2020/047750
§ 371 (c)(1),
(2) Date: Jun. 21, 2023

(87) PCT Pub. No.: WO2022/137298
PCT Pub. Date: Jun. 30, 2022

(65) Prior Publication Data

US 2024/0033815 A1 Feb. 1, 2024

(51) Int. Cl.
*B22D 13/10* (2006.01)
*B22D 13/12* (2006.01)

(52) U.S. Cl.
CPC ..... *B22D 13/101* (2013.01); *B22D 13/12* (2013.01)

(58) Field of Classification Search
CPC ..... B22D 13/10; B22D 13/101
See application file for complete search history.

(56) References Cited

U.S. PATENT DOCUMENTS 4,611,650 A 9/1986 Fort et al.

FOREIGN PATENT DOCUMENTS

| | | | |
|---|---|---|---|
| CN | 108655358 | A | 10/2018 |
| CN | 108788057 | A | 11/2018 |
| CN | 110947925 | A | 4/2020 |
| CN | 211588466 | U | 9/2020 |
| GB | 2024062 | A | 1/1980 |
| JP | 57-015973 | B2 | 4/1982 |
| JP | S59-212158 | A | 12/1984 |
| JP | 2001-062552 | A | 3/2001 |
| JP | 2003-290898 | A | 10/2003 |
| JP | 2003-326349 | A | 11/2003 |
| JP | 2004155034 | A * | 6/2004 |

OTHER PUBLICATIONS

Patent Cooperation Treaty, International Search Report, Application No. PCT/JP2020/047750, dated Feb. 22, 2021, in 6 pages.

* cited by examiner

*Primary Examiner* — Kevin E Yoon
(74) *Attorney, Agent, or Firm* — PROCOPIO, CORY, HARGREAVES & SAVITCH LLP

(57) ABSTRACT

A mold used for centrifugal casting includes a mold body formed in a cylindrical shape and a lid member (40) that is detachably assembled to an end part of the mold body in an axial direction. The lid member includes a lid body (41) that is attached to an opening part formed at the end part of the mold body, a protrusion part (450) that is fitted to the mold body, and a spring that applies elastic force to the lid body in a direction in which the lid body closely contacts the mold body.

3 Claims, 18 Drawing Sheets

CENTRIFUGAL CASTING MOLD AND CENTRIFUGAL CASTING MOLD ASSEMBLY DEVICE

TECHNICAL FIELD

The present disclosure relates to a centrifugal casting mold and a centrifugal casting mold assembly device.

BACKGROUND ART

A centrifugal casting method has been known as a method for shaping a cylindrical cast. The centrifugal casting method is a method of shaping a cylindrical cast on the inner periphery of a mold having a cylindrical shape by pouring molten metal into the mold while the mold is rotated and by pressurizing the molten metal by using centrifugal force. The mold used in such a centrifugal casting method is, for example, a mold disclosed in Patent Literature 1 below. The mold disclosed in Patent Literature 1 includes a mold body having a cylindrical shape and a lid member that is detachably mounted at one end part of the mold body. A screw ring having a circular ring shape and having a male screw part on the outer peripheral surface is fixed to one end surface of the mold body. A flange part having a female screw part on the inner peripheral surface is provided at the lid member. The lid member is fastened and assembled to the one end part of the mold body when the female screw part formed on the inner peripheral surface of the flange part of the lid member is screwed to the male screw part formed on the outer peripheral surface of the screw ring of the mold body.

CITATION LIST

Patent Literature

Patent Literature 1: Japanese Patent No. 4901281

SUMMARY OF INVENTION

Technical Problem

When the mold body is assembled to the lid member by a fastening structure including a screw mechanism like the mold disclosed in Patent Literature 1, a process of fastening the lid member to the mold body is performed a worker by using a device or a hand. Thus, force of fastening the lid member to the mold body potentially varies between workers. Accordingly, when the force of fastening the lid member to the mold body varies in a weakening direction, the lid member cannot closely contact the mold body and a gap is potentially formed therebetween. When molten metal is poured into the mold body with such a gap formed between the mold body and the lid member, such a failure that the molten metal externally leaks through the gap formed between the mold body and the lid member or the lid member is firmly fixed when the molten metal cools and thus the gap formation is not preferable.

The present disclosure is intended to provide a centrifugal casting mold in which a mold body can more reliably closely contact a lid member, and an assembly device for the centrifugal casting mold.

Solution to Problem

A centrifugal casting mold according to an aspect of the present disclosure is used for centrifugal casting and includes a mold body formed in a cylindrical shape and a lid member that is detachably assembled to an end part of the mold body in an axial direction. The lid member includes a lid body that is attached to an opening part formed at the end part of the mold body, a fitting part that is fitted to the mold body, and an elastic force application part that applies elastic force to the lid body in a direction in which the lid body closely contacts the mold body.

With this configuration, the lid body can closely contact the mold body with the elastic force of the elastic force application part, and thus the lid member can more reliably closely contact the mold body than in a case of a conventional mold in which the lid member is mounted on the mold body by using a screw fastening structure.

In the above-described centrifugal casting mold, a protrusion part protruding outward may be formed as the fitting part on an outer peripheral surface of the lid member, a groove part into which the protrusion part of the lid member is inserted may be formed at the end part of the mold body, and the protrusion part of the lid member may be fitted to the groove part of the mold body.

With this configuration, a fitting structure of the mold body and the lid member can be easily achieved.

In the above-described centrifugal casting mold, the groove part may include a first extending part having an opening part at an end face of the mold body and formed to extend in a direction parallel to the axial direction of the mold body and a second extending part formed to extend in a circumferential direction of the mold body from an end part opposite to the opening part of the first extending part, the lid member may further include a movable member including the fitting part, the movable member may be formed separately from the lid body and can be displaced relative to the lid body in the axial direction of the mold body, the protrusion part of the lid member may be fitted to the second extending part of the groove part of the mold, the elastic force application part may apply elastic force to the lid body and the movable member in a direction in which the lid body separates from the movable member in the axial direction of the mold body, and the mold may have a mechanism that the lid body closely contacts the mold body with the elastic force applied to the lid body by the elastic force application part and the fitting part is pressed to an inner wall surface of the second extending part with the elastic force applied to the movable member by the elastic force application part.

With this configuration, the fitting part is unlikely to be come off the second extending part of the groove part because of the elastic force applied to the movable member by the elastic force application part. As a result, the lid member is unlikely to fall off the mold body.

In the above-described centrifugal casting mold, a concave part into which the protrusion part is inserted may be formed at the inner wall surface of the second extending part that the protrusion part of the movable member contacts.

With this configuration, even when the protrusion part of the lid member is displaced in a direction in which the protrusion part comes off the second extending part of the groove part, the protrusion part of the lid member is prevented from coming off because the protrusion part is unlikely to come off the concave part. Thus, the lid member is more unlikely to fall off the mold body.

In the above-described centrifugal casting mold, a plurality of the protrusion parts may be formed on the outer peripheral surface of the lid member, and a plurality of groove parts in a number larger than the number of the protrusion parts may be formed at the end part of the mold body.

With this configuration, the number of groove parts into which each protrusion part can be inserted is larger than in a case in which the number of the protrusion parts and the number of the groove parts are equal to each other. As a result, the lid member can be easily assembled to the mold body.

An assembly device for the above-described centrifugal casting mold includes an attachment-detachment device configured to attach and detach the lid member to and from the end part of the mold body, and a control device configured to control the attachment-detachment device. The attachment-detachment device includes a grasping unit configured to grasp the lid member, and an image capturing unit provided at the grasping unit. When attaching the lid member to the mold body, the control device grasps the lid member with the grasping unit, and then captures an image of the end face of the mold body with the image capturing unit and detects the position of the mold body relative to the grasping unit based on image data obtained by the image capturing, and fits the fitting part of the lid member to the mold body by displacing the grasping unit based on the position of the mold body.

With this configuration, work of attaching the lid member to the mold body can be automatically performed by the attachment-detachment device, and thus convenience can be improved.

In the above-described centrifugal casting mold assembly device, the attachment-detachment device may further include a position detection unit configured to detect the position of the grasping unit relative to the mold body in the axial direction of the mold body, and the control device may fit the fitting part of the lid member to the mold body by further displacing the grasping unit based on the position of the grasping unit detected by the position detection unit.

With this configuration, the grasping unit can be more accurately displaced, and thus the lid member can be further accurately attached to the mold body.

In the above-described centrifugal casting mold assembly device, the control device may displace the grasping unit in a direction in which the fitting part of the lid member is fitted to the mold body, and then captures an image of the end face of the mold body with the image capturing unit, determine whether the fitting part of the lid member is fitted to the mold body based on image data obtained by the image capturing, and determine that the attachment of the lid member to the mold body is normally performed when having determined that the fitting part of the lid member is fitted to the mold body.

With this configuration, whether the process of attaching the lid member to the mold body is normally performed can be accurately detected.

In the above-described centrifugal casting mold assembly device, when detaching the lid member from the mold body, the control device may capture an image of the end face of the mold body with the image capturing unit, detect the position of the mold body relative to the grasping unit based on image data obtained by the image capturing, grasp the lid member with the grasping unit by displacing the grasping unit based on the position of the mold body, and then cancel a state in which the fitting part of the lid member is fitted to the mold body by further displacing the grasping unit.

With this configuration, work of detaching the lid member from the mold body can be automatically performed by the attachment-detachment device, and thus convenience can be improved.

DESCRIPTION OF EMBODIMENT

Figure 1:
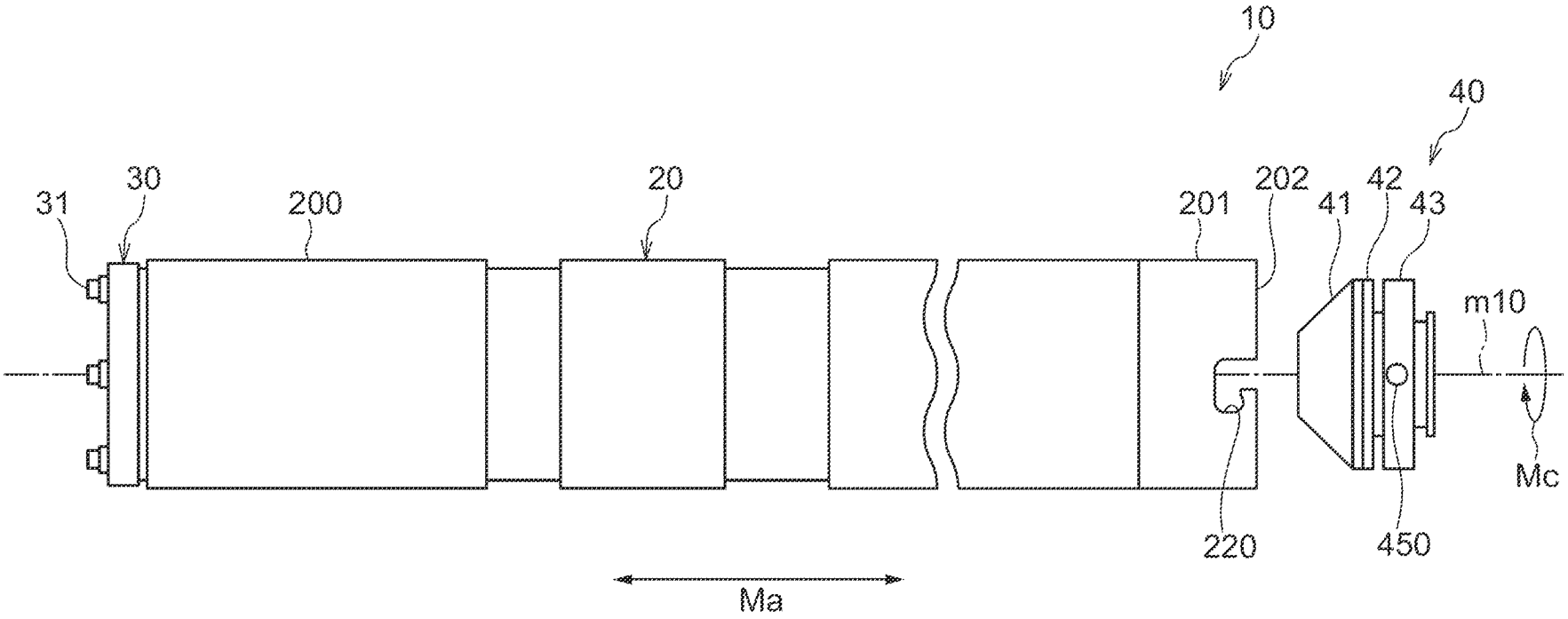
FIG. 1 is a side view illustrating a side surface structure of a mold of an embodiment.

An embodiment of a centrifugal casting mold and a centrifugal casting mold assembly device will be described below with reference to the accompanying drawings. To facilitate understanding of the description, any identical constituent components in the drawings are denoted by the same reference sign when possible, and duplicate description thereof is omitted.

First, a mold 10 of the present embodiment will be described below with reference to FIG. 1. As illustrated in FIG. 1, the mold 10 includes a mold body 20 and lid members 30 and 40. The mold body 20 is formed in a cylindrical shape about an axis line m10. In the following description, the axis line m10 is also referred to as a "central axis m10", and a direction parallel to the axis line m10 is referred to as an "axial direction Ma". The circumferential direction of the mold body 20, in other words, the circumferential direction about the axis line m10 is referred to as a "circumferential direction Mc".

End parts 200 and 201 of the mold body 20 are both opened. The one lid member 30 is attached to an opening part of the one end part 200 of the mold body 20. The lid member 30 is fastened and fixed to the one end part 200 of the mold body 20 by a bolt 31. The other lid member 40 is attached to an opening part of the other end part 201 of the mold body 20. The lid member 40 is detachably attached to the other end part 201 of the mold body 20.

The mold 10 illustrated in FIG. 1 is used in a process of manufacturing a cylindrical cast by centrifugal casting. In the manufacturing process, the lid member 40 is attached to the end part 201 of the mold body 20, and then molten metal is poured from a molten metal supply furnace into the mold 10 through a through-hole of the lid member 30 while the mold 10 is rotated. Accordingly, the molten metal is pressed against the inner peripheral surface of the mold body 20 by centrifugal force. Thereafter, the molten metal is solidified by cooling the mold 10 to shape a cylindrical cast inside the mold body 20. Subsequently, the lid member 40 is detached from the end part 201 of the mold body 20, and then a process of removing the cast from the mold body 20 is performed, which completes the cast manufacturing. After the removing process, for example, a cleaning process of cleaning the mold body 20 and the lid member 40 with a brush or the like and a lining process of applying a lining to the inner peripheral surface of the mold body 20 are performed to prepare for shaping of a next cast with the mold 10.

The structures of the mold body 20 and the lid member 40 will be described below in detail.

Figure 2:
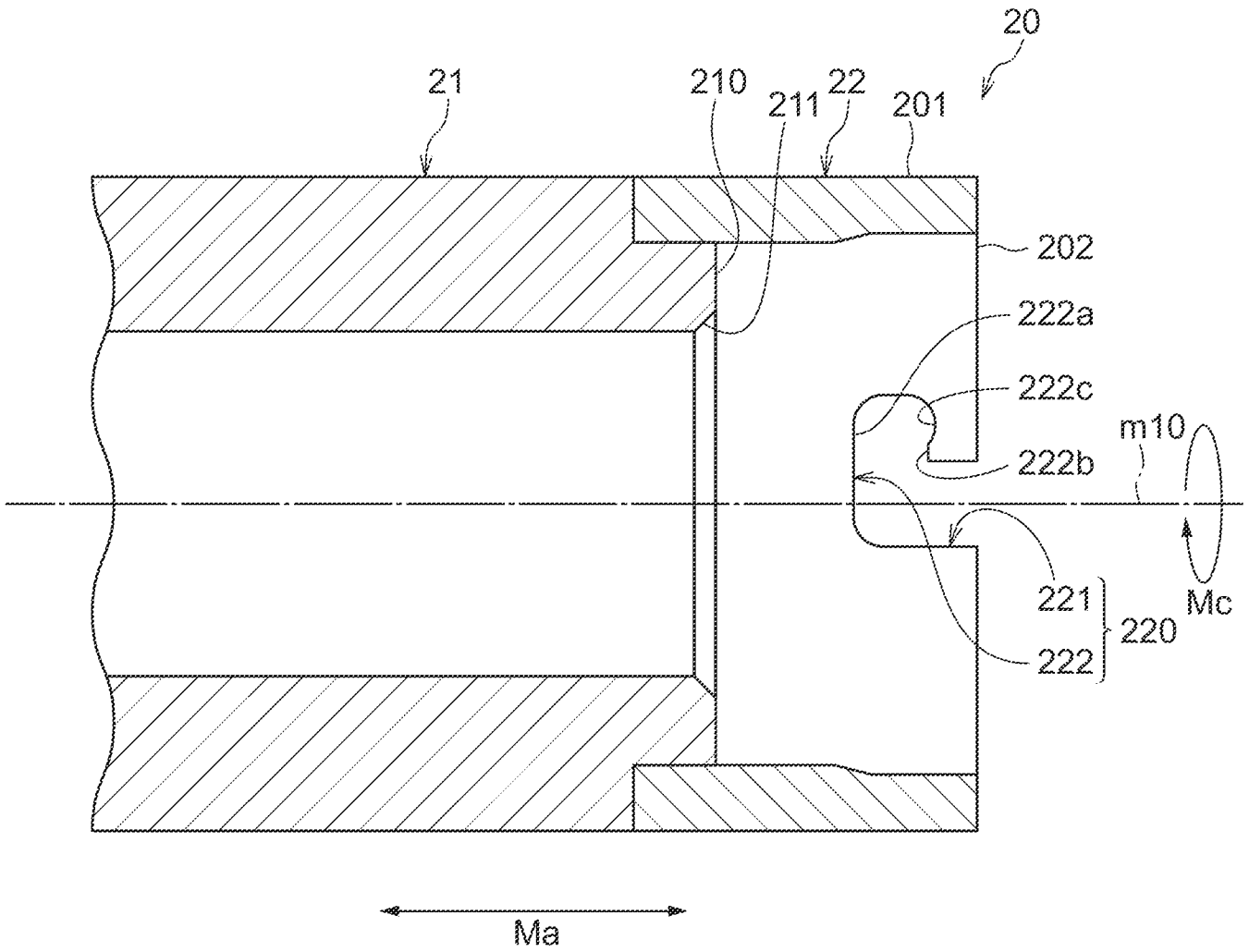
FIG. 2 is a cross-sectional view illustrating a sectional structure of a mold body of the embodiment.

As illustrated in FIG. 2, the mold body 20 includes a cylindrical member 21 and a stopper ring 22.

The cylindrical member 21 is formed in a cylindrical shape about the axis line m10 and formed to extend in the axial direction Ma. The cylindrical member 21 is a part into which molten metal is poured, in other words, a part in which a cast is shaped. A tapered surface 211 is formed at the inner wall surface of one end part 210 of the cylindrical member 21.

Figure 3:
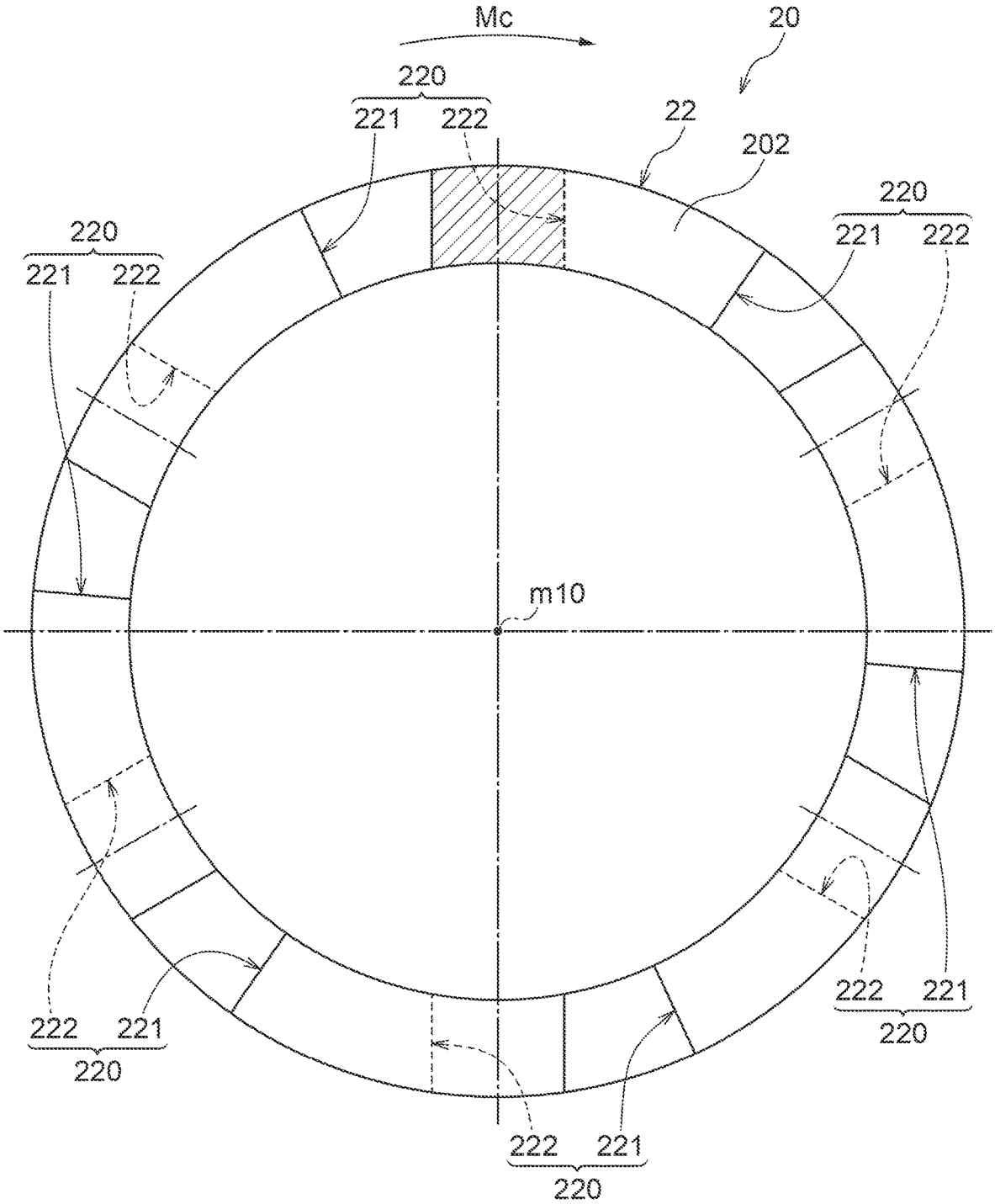
FIG. 3 is an end face diagram illustrating an end face structure of the mold body of the embodiment.

The stopper ring 22 is integrally fixed to the one end part 210 of the cylindrical member 21. The stopper ring 22 is formed in a cylindrical shape about the axis line m10. The stopper ring 22 is provided as a part to which the lid member 40 is attached. Specifically, a groove part 220 is formed at the stopper ring 22. The groove part 220 includes a first extending part 221 and a second extending part 222 and is formed in a J shape as a whole, the first extending part 221 having an opening part at an end face 202 of the stopper ring 22 and formed to extend in the axial direction Ma, the second extending part 222 being formed to extend in the circumferential direction Mc from an end part opposite to the opening part of the first extending part 221. The second extending part 222 has inner wall surfaces 222*a* and 222*b* extending in the circumferential direction Mc, and a concave part 222*c* is formed at the inner wall surface 222*b* disposed near the end face 202 of the stopper ring 22. As illustrated in FIG. 3, a plurality of groove parts 220 are formed at the stopper ring 22 at equally spaced angles in the circumferential direction Mc.

Note that, in the mold 10 of the present embodiment, the stopper ring 22 is a constituent component of the mold body 20. Accordingly, the end face 202 of the stopper ring 22 is an end face of the mold body 20, and thus the end face 202 is also referred to as "the end face 202 of the mold body 20" in the following description.

Figure 4:
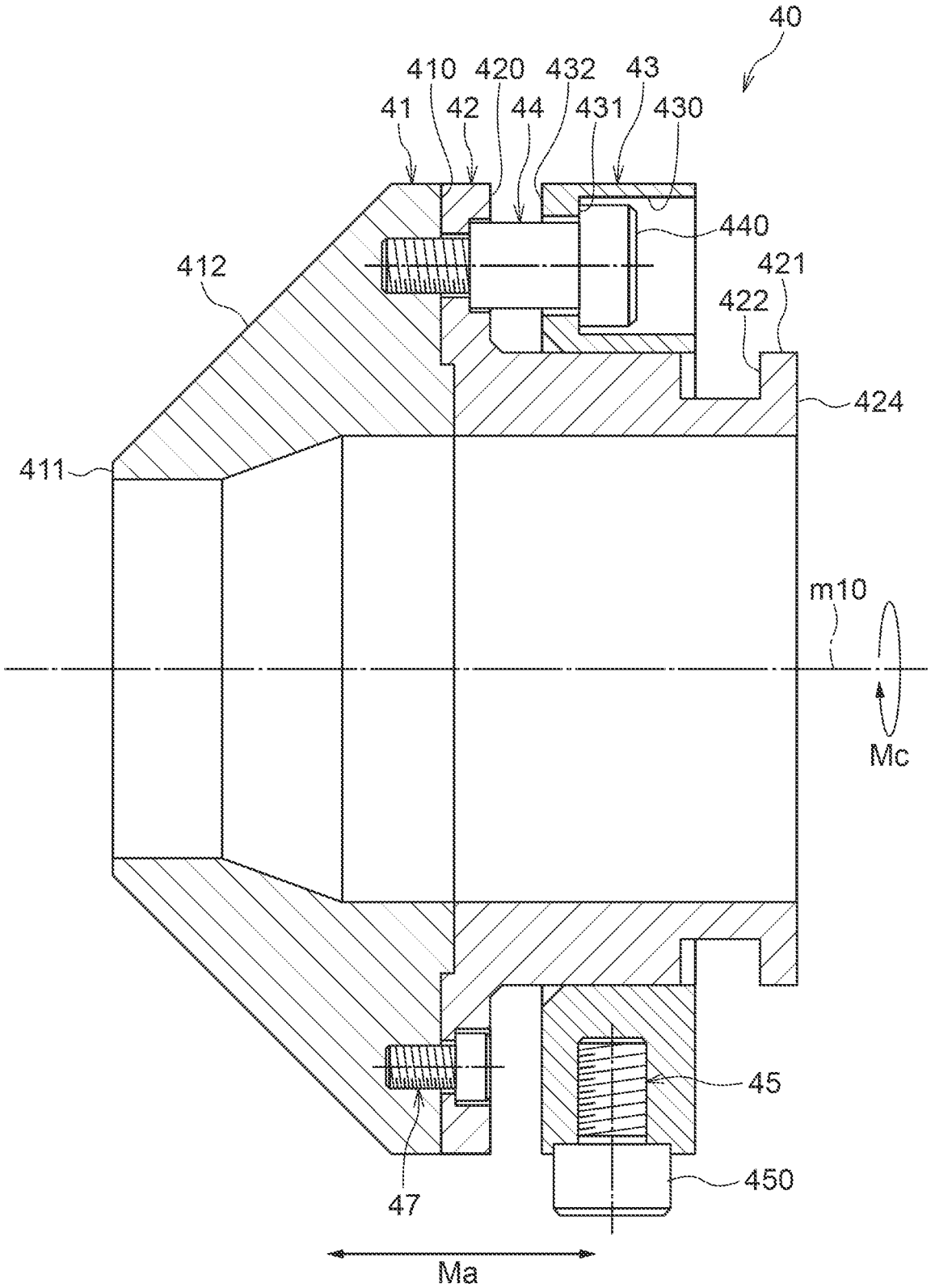
FIG. 4 is a cross-sectional view illustrating a sectional structure of a lid member of the embodiment.

As illustrated in FIG. 4, the lid member 40 includes a lid body 41, a flange part 42, and a movable ring 43.

The lid body 41 is formed in a substantially circular truncated cone shape about the axis line m10 and tapered in a direction from a proximal end part 410 to a distal end part 411 opposite thereto. When the lid member 40 is mounted on the mold body 20, a tilt surface 412 of the lid body 41 closely contacts the tapered surface 211 formed at the inner periphery of the cylindrical member 21 of the mold body 20 illustrated in FIG. 2.

As illustrated in FIG. 4, the flange part 42 is fastened and fixed to the proximal end part 410 of the lid body 41 by a stepped bolt 44 and a small-sized bolt 47. Note that a plurality of stepped bolts 44 and a plurality of small-sized bolts 47 are provided in the circumferential direction Mc. The flange part 42 includes a cylindrical part 421 extending in a cylindrical shape along the axis line m10 from an outer surface 420 opposite to a surface of the flange part 42 that the lid body 41 closely contacts. A chuck groove 422 having a concave shape and extending in the circumferential direction Mc is formed at the outer peripheral surface of a distal end part of the cylindrical part 421.

Figure 5:
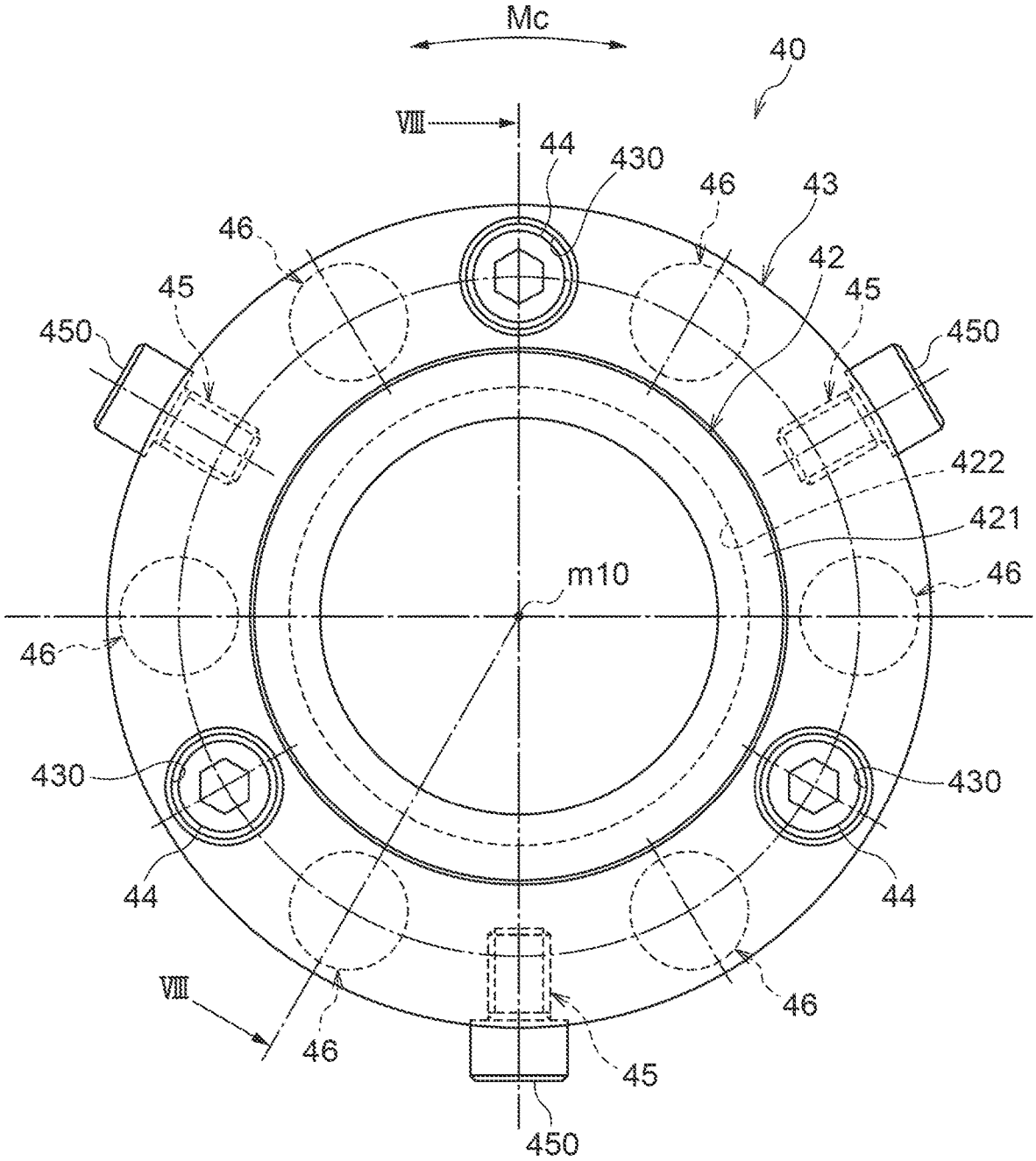
FIG. 5 is an end face diagram illustrating an end face structure of the lid member of the embodiment.

The movable ring 43 is a member formed in a circular ring shape about the axis line m10 and fitted to the outer periphery of the cylindrical part 421 of the flange part 42. The length of the movable ring 43 in the axial direction Ma is shorter than the length of the cylindrical part 421 of the flange part 42 in the axial direction Ma. The movable ring 43 is formed separately from the lid body 41 and the flange part 42 and can be displaced relative to the lid body 41 and the flange part 42 in the axial direction Ma. In the present embodiment, the movable ring 43 corresponds to a movable member. An insertion hole 430 is formed through the movable ring 43 in a direction parallel to the axial direction Ma. A stepped bolt 44 is inserted into the insertion hole 430. A stepped part 431 that engages with a head 440 of the stepped bolt 44 in the axial direction Ma is formed at the inner wall surface of the insertion hole 430. The movable ring 43 is prevented from coming off the flange part 42 when the head 440 of the stepped bolt 44 engages with the stepped part 431 of the insertion hole 430 in the axial direction Ma. As illustrated in FIG. 5, a plurality of insertion holes 430 in a number equal to the number of the stepped bolts 44 are formed through the movable ring 43.

Figure 6:
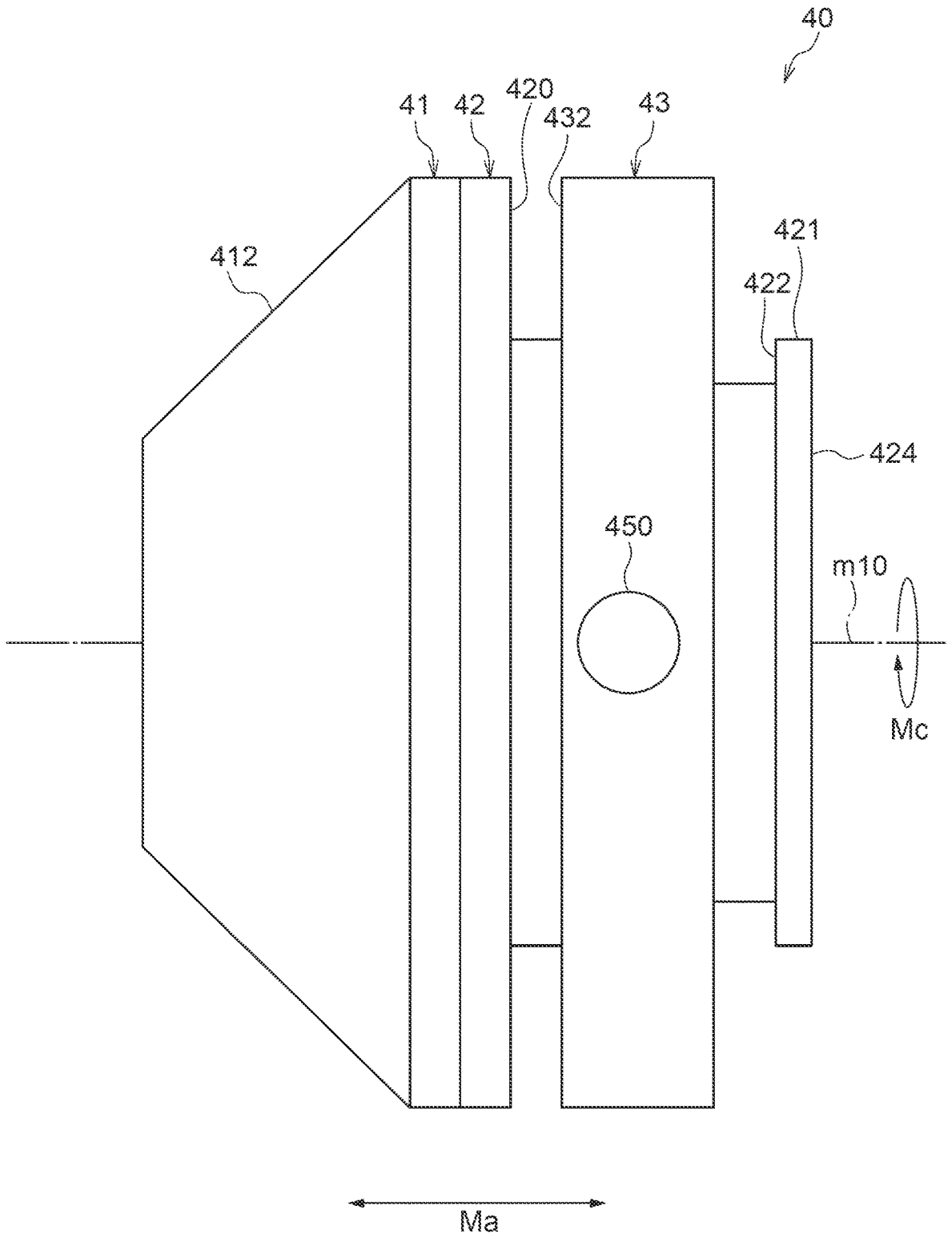
FIG. 6 is a side view illustrating a side surface structure of the lid member of the embodiment.
Figure 7:
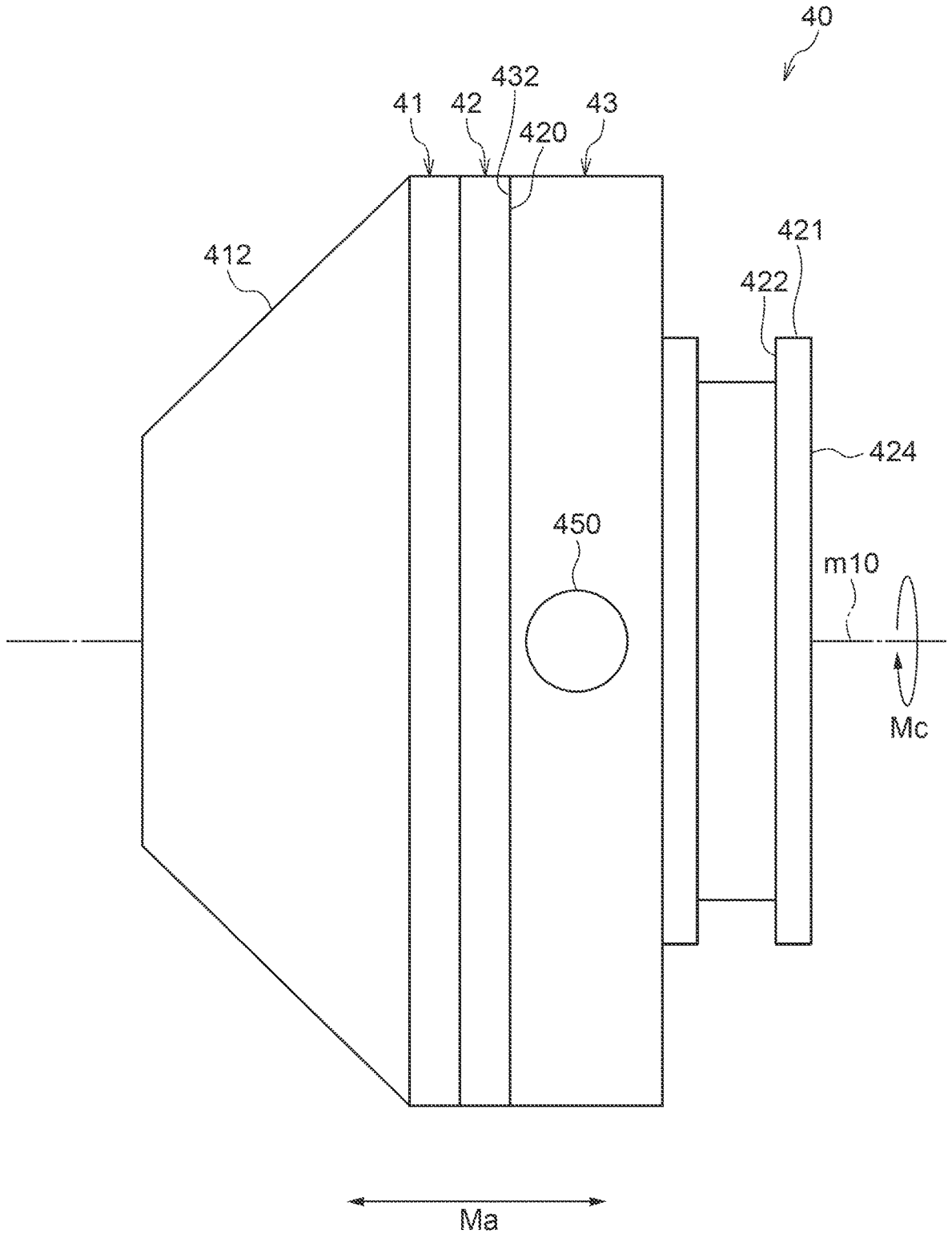
FIG. 7 is a side view illustrating exemplary operation of the lid member of the embodiment.

As illustrated in FIG. 4, a gap is formed between the outer surface 420 of the flange part 42 and an end face 432 of the movable ring 43 when the head 440 of each stepped bolt 44 contacts the stepped part 431 of the corresponding insertion hole 430 of the movable ring 43. FIG. 6 illustrates a side surface structure of the lid member 40 illustrated in FIG. 4. The movable ring 43 can be displaced from a position illustrated in FIG. 6 to a position at which the movable ring 43 contacts the outer surface 420 of the flange part 42 as illustrated in FIG. 7.

As illustrated in FIG. 4, a fitting bolt 45 is screwed into the outer peripheral surface of the movable ring 43. A head 450 of the fitting bolt 45 protrudes outward from the outer peripheral surface of the movable ring 43. As illustrated in FIG. 5, a plurality of fitting bolts 45 are provided at the outer peripheral surface of the movable ring 43. The lid member 40 is attached to the mold body 20 when the head 450 of each fitting bolt 45 is fitted to the corresponding groove part 220 of the stopper ring 22 illustrated in FIG. 2. In the present embodiment, the head 450 of each fitting bolt 45 corresponds to a fitting part and a protrusion part. In the following description, the head 450 of each fitting bolt 45 is referred to as a "protrusion part 450". As illustrated in FIG. 1, the lid member 40 is attached to the mold body 20 when each protrusion part 450 of the movable ring 43 is fitted to the corresponding groove part 220 of the mold body 20.

Note that, as clearly understood from comparison between FIGS. 3 and 5, the number of the groove parts 220 of the mold body 20 is larger than the number of the protrusion parts 450 of the movable ring 43.

Specifically, in the mold 10 of the present embodiment, the number of the protrusion parts 450 of the movable ring 43 is three whereas the number of the groove parts 220 of the mold body 20 is six.

Figure 8:
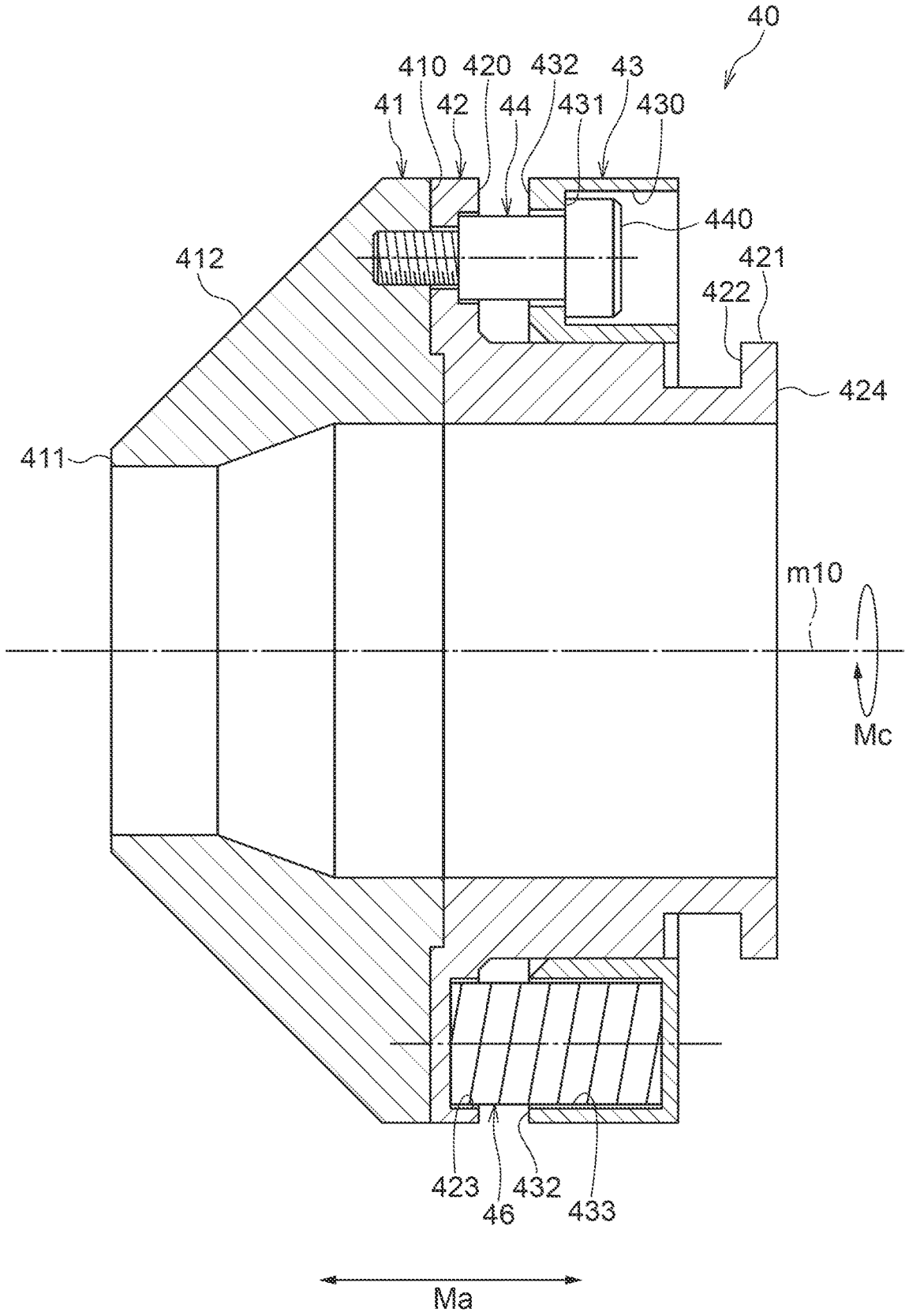
FIG. 8 is a cross-sectional view illustrating sectional structure along line VIII-VIII in FIG. 5.

FIG. 8 illustrates a sectional structure along line VIII-VIII in FIG. 5. As illustrated in FIG. 8, the lid member 40 further includes a spring 46 disposed in a compressed state between the flange part 42 and the movable ring 43. As illustrated in FIG. 5, a plurality of springs 46 are provided in the circumferential direction Mc. As illustrated in FIG. 8, one end part of each spring 46 is inserted into a groove 423 formed in a concave shape at the outer surface 420 of the flange part 42. The other end part of the spring 46 is inserted into a groove 433 formed in a concave shape at the end face 432 of the movable ring 43. The spring 46 applies elastic force to the movable ring 43 in a direction in which the movable ring 43 separates from the flange part 42. Accordingly, the movable ring 43 is held at a position illustrated in FIG. 6, in other words, a position separated from the outer surface 420 of the flange part 42. In the present embodiment, the spring 46 corresponds to an elastic force application part.

A method of attaching the lid member 40 to the mold body 20 of the present embodiment will be described below.

Figure 9:
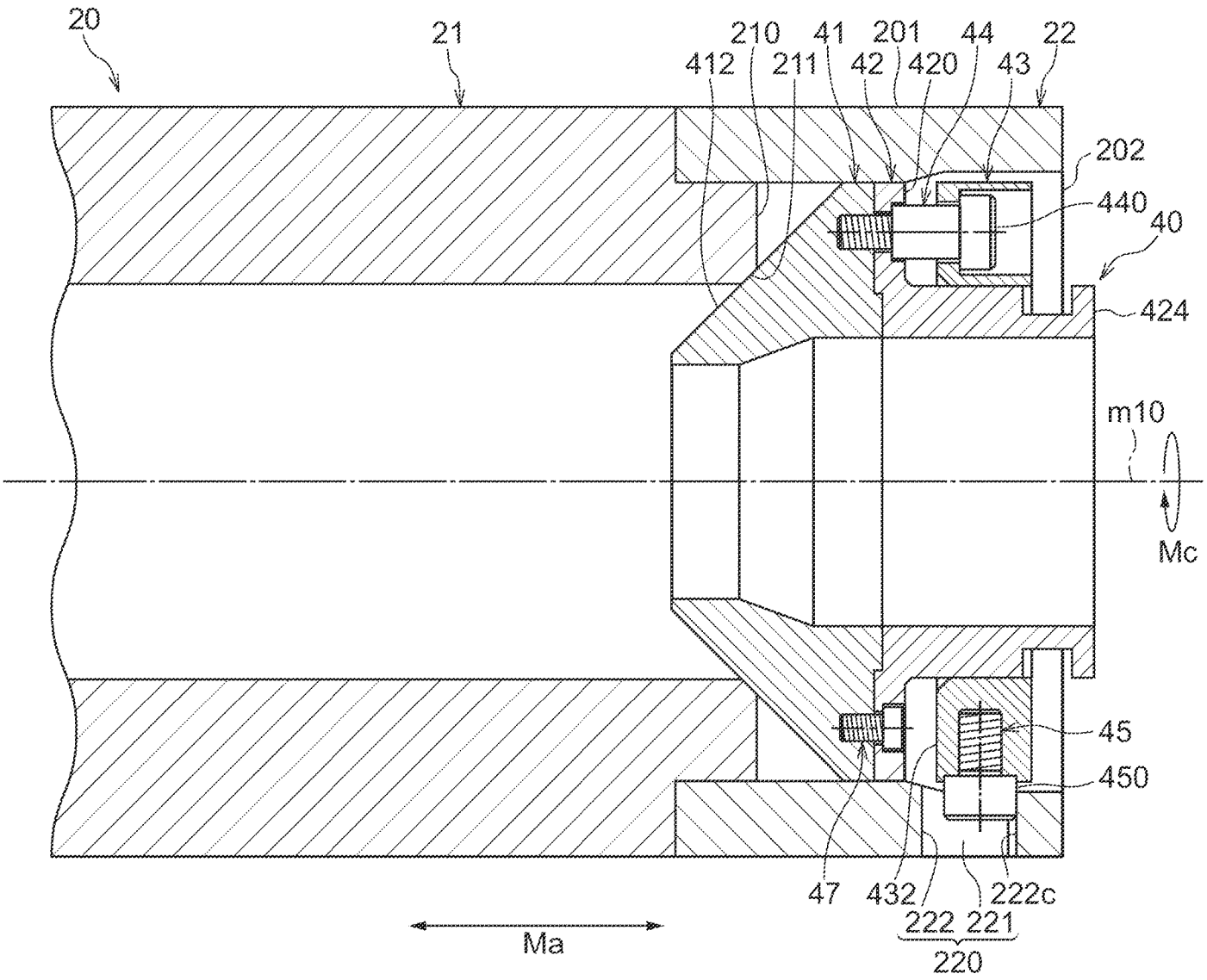
FIG. 9 is a cross-sectional view illustrating a sectional structure of the mold of the embodiment.

When the lid member 40 is to be attached to the mold body 20, first, pressing force is applied to an end face of the movable ring 43 of the lid member 40, which is opposite to the end face 432, to press the movable ring 43 toward the flange part 42 against elastic force of the springs 46 so that the movable ring 43 of the lid member 40 closely contacts the flange part 42 as illustrated in FIG. 7. Thereafter, the protrusion parts 450 of the lid member 40 are inserted into the groove parts 220 of the mold body 20 while the pressing force is applied to the movable ring 43. Specifically, the protrusion parts 450 of the lid member 40 are inserted into the first extending parts 221 of the groove parts 220 of the mold body 20 by displacing the lid member 40 relative to the mold body 20 in the axial direction Ma. Subsequently, the protrusion parts 450 of the lid member 40 are inserted into the second extending parts 222 of the groove parts 220 of the mold body 20 by rotating the lid member 40 in the circumferential direction Mc. After the protrusion parts 450 of the lid member 40 are inserted into the groove parts 220 of the mold body 20 in this manner, the pressing force applied to the movable ring 43 is canceled. Accordingly, the elastic force of the springs 46 is applied as force in a direction in which the lid body 41 of the lid member 40 separates from the stopper ring 22 in the axial direction Ma. With the elastic force of the springs 46, a state in which the protrusion parts 450 of the lid member 40 are fitted to the groove parts 220 of the mold body 20 and a state in which the tilt surface 412 of the lid body 41 closely contacts the tapered surface 211 of the inner periphery of the mold body 20 are achieved and held as illustrated in FIG. 9. In this case, the protrusion parts 450 of the lid member 40 are inserted into the concave parts 222*c* formed at the inner wall surfaces 222*b* of the stopper ring 22. Through such a process, the lid member 40 is attached to the opening part of the end part 201 of the mold body 20.

The above-described process of attaching the lid member 40 can be performed by, for example, a worker. In the present embodiment, the process of attaching the lid member 40 is automatically performed by an assembly device 50 as illustrated in FIG. 10 to improve operation efficiency.

The configuration of the assembly device 50 will be specifically described below.

Figure 10:
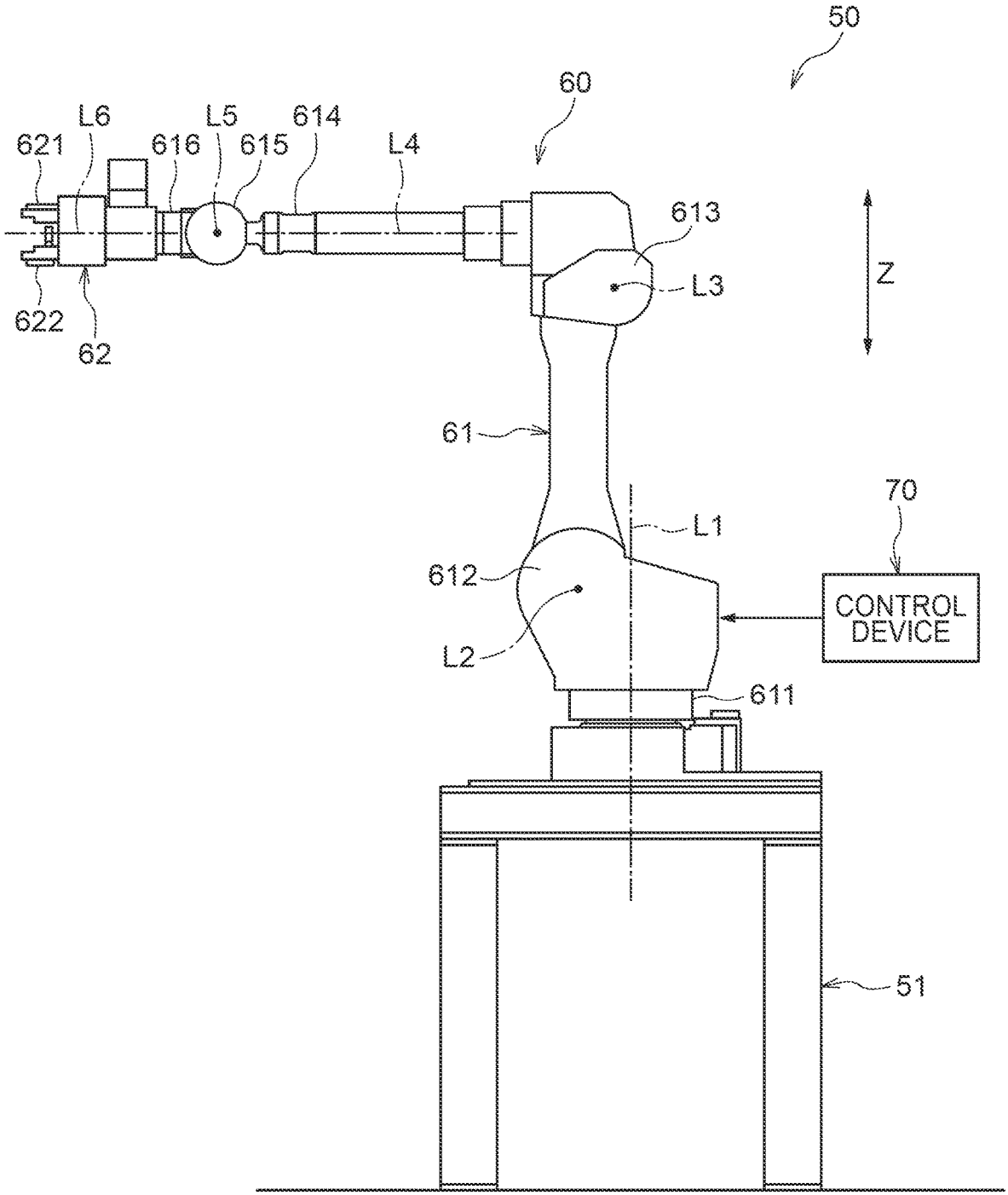
FIG. 10 is a side view illustrating a side surface structure of an attachment-detachment device of the embodiment.

As illustrated in FIG. 10, the assembly device 50 includes an attachment-detachment device 60 and a control device 70.

The attachment-detachment device 60 is a robotic-arm device and performs attachment of the lid member 40 to the mold body 20 and detachment of the lid member 40 from the mold body 20. The attachment-detachment device 60 includes an arm unit 61 and a hand unit 62.

The arm unit 61 has what is called a six-axis vertical multi-joint structure including first to sixth joint parts 611 to 616 that are rotatable about first to sixth axes L1 to L6 illustrated in FIG. 10. Accordingly, the arm unit 61 can displace the hand unit 62 in six axial directions. The first axis L1 is a direction parallel to a vertical direction Z in the drawing, the second axis L2 is a direction orthogonal to the first axis L1, the third axis L3 is a direction parallel to the second axis L2, the fourth axis L4 is a direction orthogonal to the third axis L3, the fifth axis L5 is a direction orthogonal to the fourth axis L4, and the sixth axis L6 is a direction orthogonal to the fifth axis L5. The joint parts 611 to 616 each include an actuator configured to generate power based on electric power supply, a decelerator configured to decelerate and output the power of the actuator, and a rotation sensor configured to detect the rotation angles of the joint part. The joint parts 611 to 616 are each driven based on the power output from the decelerator. The arm unit 61 is installed on a base 51.

Figure 11:
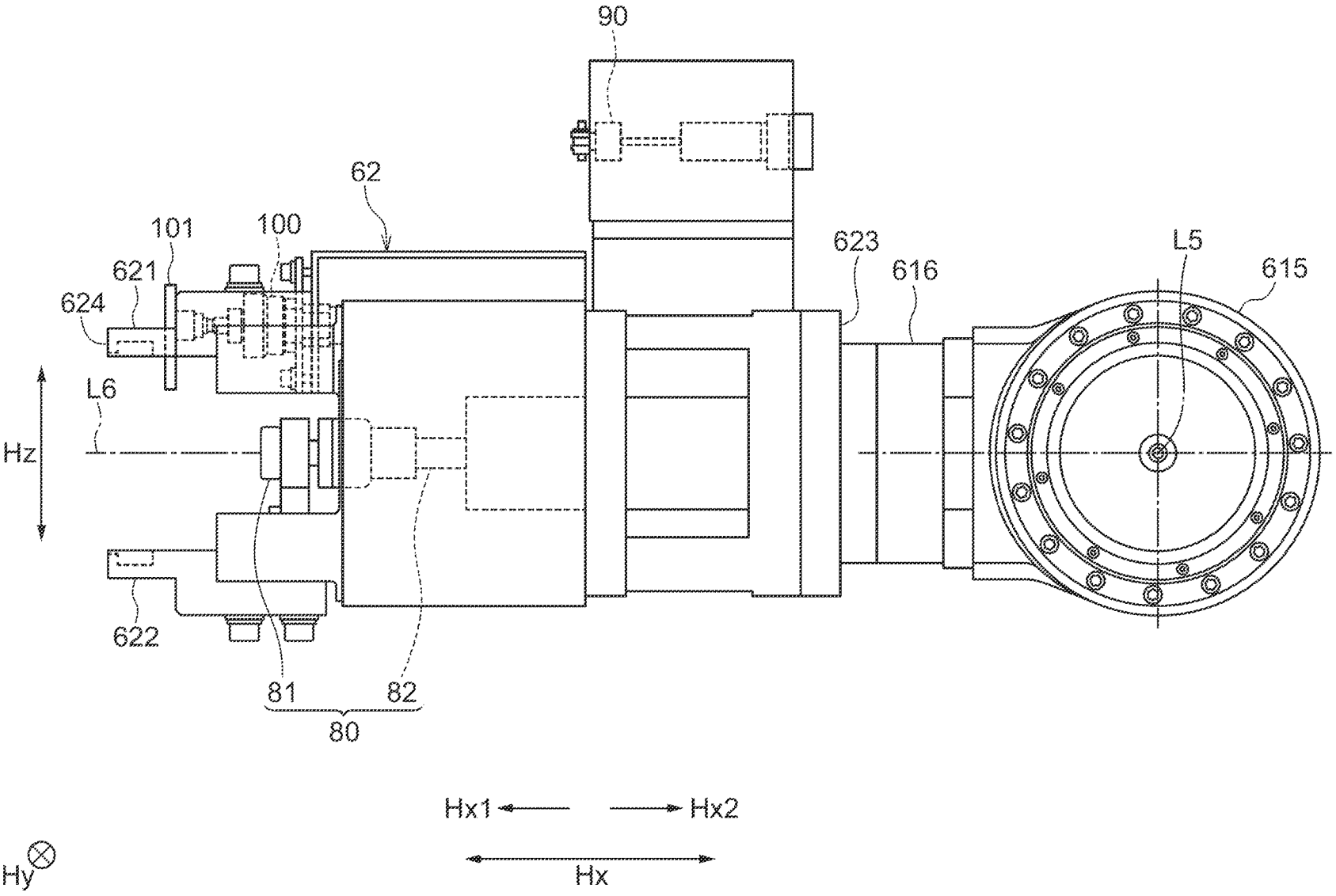
FIG. 11 is a side view illustrating a side surface structure around a click part of the attachment-detachment device of the embodiment.

The hand unit 62 is provided at a distal end part of the sixth joint part 616. The hand unit 62 is a part configured to grasp the lid member 40. Specifically, as illustrated in FIG. 11, the hand unit 62 includes a first click part 621 and a second click part 622. The first click part 621 and the second click part 622 approach and separate from each other in a direction illustrated with an arrow Hz. The Hz direction is a direction orthogonal to the sixth axis L6. The lid member 40 can be grasped when the first click part 621 and the second click part 622 approach each other. The grasped lid member 40 can be released when the first click part 621 and the second click part 622 separate from each other. The hand unit 62 includes an actuator configured to generate power based on electric power supply, a decelerator configured to decelerate and output the power of the actuator, and a position sensor configured to detect opened and closed positions of the first click part 621 and the second click part 622. The first click part 621 and the second click part 622 are driven based on, for example, power of compression air. In the present embodiment, the hand unit 62 corresponds to a grasping unit.

As illustrated in FIG. 11, the hand unit 62 is provided with a pressing mechanism 80, an image capturing device 90, and a position sensor 100.

The pressing mechanism 80 includes a pressing unit 81 and a power generation unit 82.

The pressing unit 81 is attached to the hand unit 62 such that the pressing unit 81 can be relatively displaced in a direction illustrated with an arrow Hx. The Hx direction is a direction parallel to the sixth axis L6.

In the following description, a direction orthogonal to both the Hx direction and the Hz direction is referred to as an "Hy direction". In the Hx direction, a direction from a proximal end part 623 to a distal end part 624 of the hand unit 62 is referred to as an "Hx1 direction", and a direction from the distal end part 624 to the proximal end part 623 of the hand unit 62 is referred to as an "Hx2 direction".

The power generation unit 82 applies force in the Hx direction to the pressing unit 81 by using force of compression air or the like. In the pressing mechanism 80, the pressing unit 81 is displaced in the Hx direction based on the force applied to the pressing unit 81 by the power generation unit 82, and accordingly, the click parts 621 and 622 can grasp the chuck groove 422 of the lid member 40 and the pressing unit 81 can press the end face of the movable ring 43 opposite to the end face 432.

The image capturing device 90 is fixed and attached to an outer periphery part of the proximal end part 623 of the hand unit 62. The image capturing device 90 is a camera or the like and generates image data by capturing an image of an image capturing region that is a front side of the hand unit 62. For example, when the lid member 40 is to be attached to the mold body 20, the image capturing device 90 captures an image of the end face 202 of the mold body 20 of the stopper ring 22 and generates image data of the image.

The position sensor 100 is an air-cylinder position sensor and includes a contact part 101. When receiving force in the Hx2 direction, the contact part 101 is pressed and displaced relative to the hand unit 62 in the Hx2 direction. The position sensor 100 is a sensor configured to output an on-signal based on the displacement of the contact part 101 in the Hx2 direction. Accordingly, the output signal from the position sensor 100 switches from an off-state to an on-state when the contact part 101 contacts the mold body 20 while the hand unit 62 is displaced in the Hx1 direction. Thereafter, the contact part 101 returns to an initial position illustrated in FIG. 11 when the contact part 101 separates from the mold body 20 and the force applied to the contact part 101 is canceled. Accordingly, the output signal from the position sensor 100 switches from the on-state to the off-state. In the present embodiment, the position sensor 100 corresponds to a position detection unit.

Figure 12:
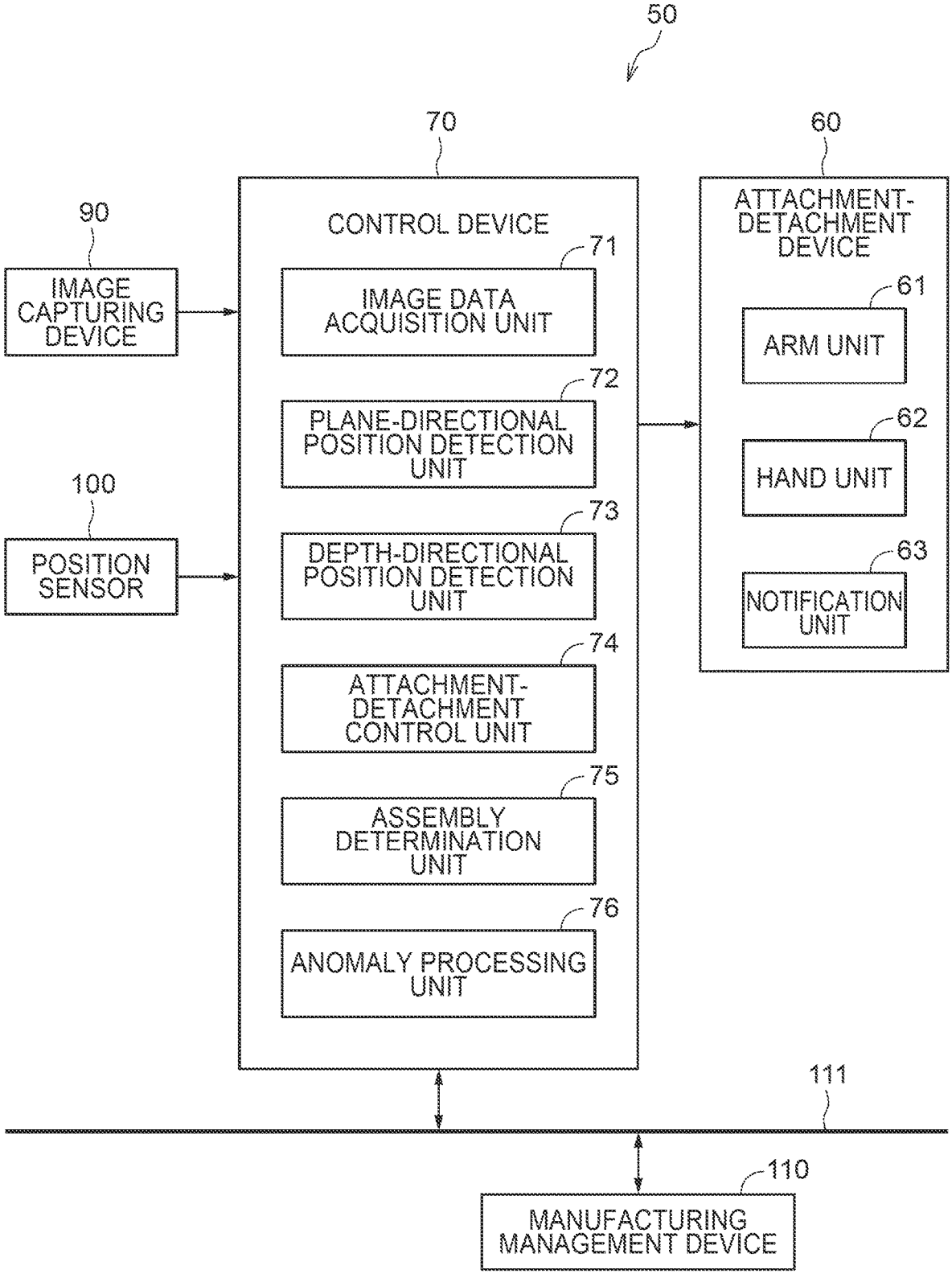
FIG. 12 is a block diagram illustrating a schematic configuration of an assembly device of the embodiment.

The control device 70 illustrated in FIG. 12 is mainly constituted by a microcomputer including a processor and a storage unit. The control device 70 controls the attachment-detachment device 60 by executing a computer program stored in the storage unit in advance.

Specifically, as illustrated in FIG. 12, the control device 70 is connected to a manufacturing management device 110 through a network line 111 such as a local area network (LAN) to perform communication therebetween. The manufacturing management device 110 is a device that collectively manages a production line through which a cylindrical cast such as a cylinder liner is shaped. Cylindrical casts are sequentially shaped as a plurality of molds 10 flows through the production line. The production line is provided with, in addition to the attachment-detachment device 60 that attaches and detaches the lid member 40 to and from the mold body 20, various manufacturing devices such as a truck that transports a mold 10, a molten metal supply furnace that supplies molten metal to the mold 10, and a device that removes a cylindrical cast from the mold 10. The manufacturing management device 110 controls the production line by transmitting command signals to various manufacturing devices on the production line while monitoring the states of a plurality of molds 10 flowing through the production line. For example, a command signal that instructs attachment of the lid member 40 to the mold body 20 and a command signal that instructs detachment of the lid member 40 from the mold body 20 are transmitted from the manufacturing management device 110 to the control device 70.

The control device 70 includes, as functional elements achieved as the processor executes a computer program stored in the storage unit, an image data acquisition unit 71, a plane-directional position detection unit 72, a depth-directional position detection unit 73, an attachment-detachment control unit 74, an assembly determination unit 75, and an anomaly processing unit 76.

The image data acquisition unit 71 acquires image data by capturing an image of a front side region of the hand unit 62 with the image capturing device 90 and provides appropriate image processing to the acquired image data.

The plane-directional position detection unit 72 detects the position of an object existing on the front side of the hand unit 62, more specifically, the position of the object relative to the hand unit 62 based on the image data acquired by the image data acquisition unit 71. The plane-directional position detection unit 72 can accurately detect the position of an object in a plane including the Hy and Hz directions illustrated in FIG. 11, in other words, a plane orthogonal to the Hx direction.

The depth-directional position detection unit 73 illustrated in FIG. 12 detects whether the contact part 101 of the position sensor 100 contacts any object in the Hx direction based on an output signal from the position sensor 100. Specifically, the depth-directional position detection unit 73 determines that the hand unit 62 contacts an object existing on the front side based on switching of the output signal from the position sensor 100 from an off-state to an on-state.

The attachment-detachment control unit 74 performs attachment of the lid member 40 to the mold body 20 and detachment of the lid member 40 from the mold body 20 by detecting the positions of the mold body 20 and the hand unit 62 with the plane-directional position detection unit 72 and the depth-directional position detection unit 73 and driving the attachment-detachment device 60 based on the detected positions.

The assembly determination unit 75 determines whether assembly of the lid member 40 to the mold body 20 is normally performed by using the image data acquired by the image data acquisition unit 71.

When it is determined that the attachment of the lid member 40 to the mold body 20 is not normally performed, the anomaly processing unit 76 executes processing corresponding to the anomaly, such as issuing of an alert from a notification unit 63 provided at the attachment-detachment device 60.

Specific procedures of processing of attaching the lid member 40 and processing of detaching the lid member 40 executed by the control device 70 will be described below.

Figure 13:
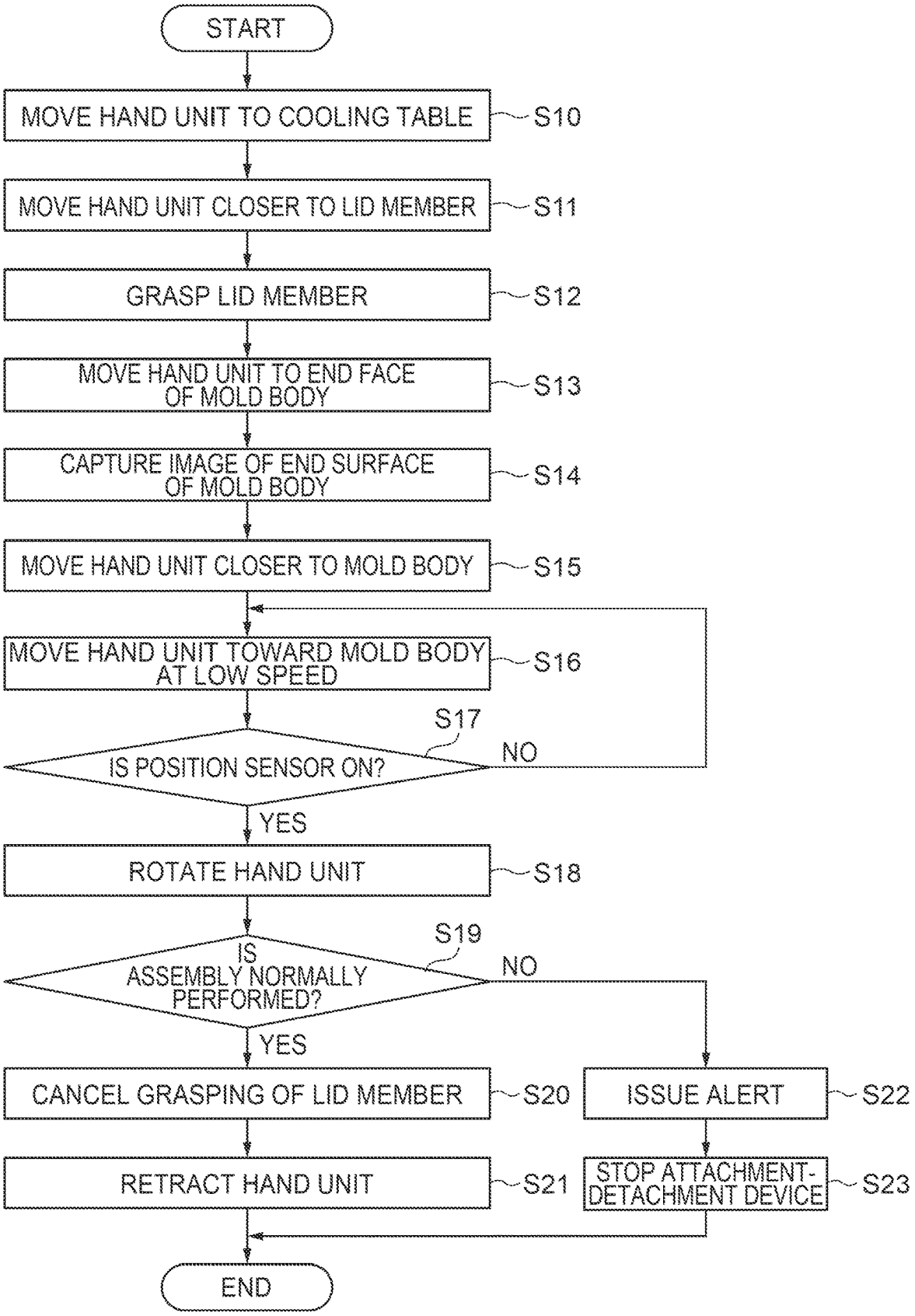
FIG. 13 is a flowchart illustrating the procedure of processing executed by a control device of the embodiment.

Description will be first made on the procedure of processing of attaching the lid member 40 with reference to FIG. 13. Note that the control device 70 starts processing illustrated in FIG. 13 based on reception of an instruction for attachment of the lid member 40 to the mold body 20, which is transmitted from the manufacturing management device 110.

As illustrated in FIG. 13, the attachment-detachment control unit 74 of the control device 70 first drives the arm unit 61 of the attachment-detachment device 60 to move the hand unit 62 from a standby position to a position above the lid member 40 placed on a cooling table on the production line (step S10). On the production line, the lid member 40 detached from the mold body 20 is cleaned by a cleaning device and cooled and then is placed on a predetermined cooling table and cooled by cooling water. Accordingly, one or a plurality of lid members 40 cleaned and cooled are placed on the cooling table. Each lid member 40 is placed on the cooling table such that an end face 424 of the cylindrical part 421 of the flange part 42 illustrated in FIG. 4 faces upward.

After the processing at step S10, the attachment-detachment control unit 74 drives the arm unit 61 of the attachment-detachment device 60 based on predetermined coordinate data to move the hand unit 62 closer to the lid member 40 to a position where the lid member 40 can be grasped (step S11).

After the processing at step S11, the attachment-detachment control unit 74 grasps the lid member 40 with the hand unit 62 by driving the hand unit 62 so that the first click part 621 and the second click part 622 are closed (step S12). Specifically, the attachment-detachment control unit 74 grasps the chuck groove 422 illustrated in FIG. 6 with the hand unit 62. After grasping the lid member 40 with the hand unit 62, the attachment-detachment control unit 74 drives the pressing mechanism 80 of the hand unit 62 to apply pressing force to the movable ring 43 of the lid member 40 so that the movable ring 43 is pressed toward the flange part 42 against elastic force of the springs 46. Accordingly, the movable ring 43 of the lid member 40 closely contacts the flange part 42 as illustrated in FIG. 7. Subsequently, the attachment-detachment control unit 74 continues driving of the pressing mechanism 80 to maintain the state in which the movable ring 43 closely contacts the flange part 42 until the lid member 40 is attached to the mold body 20.

Figure 14:
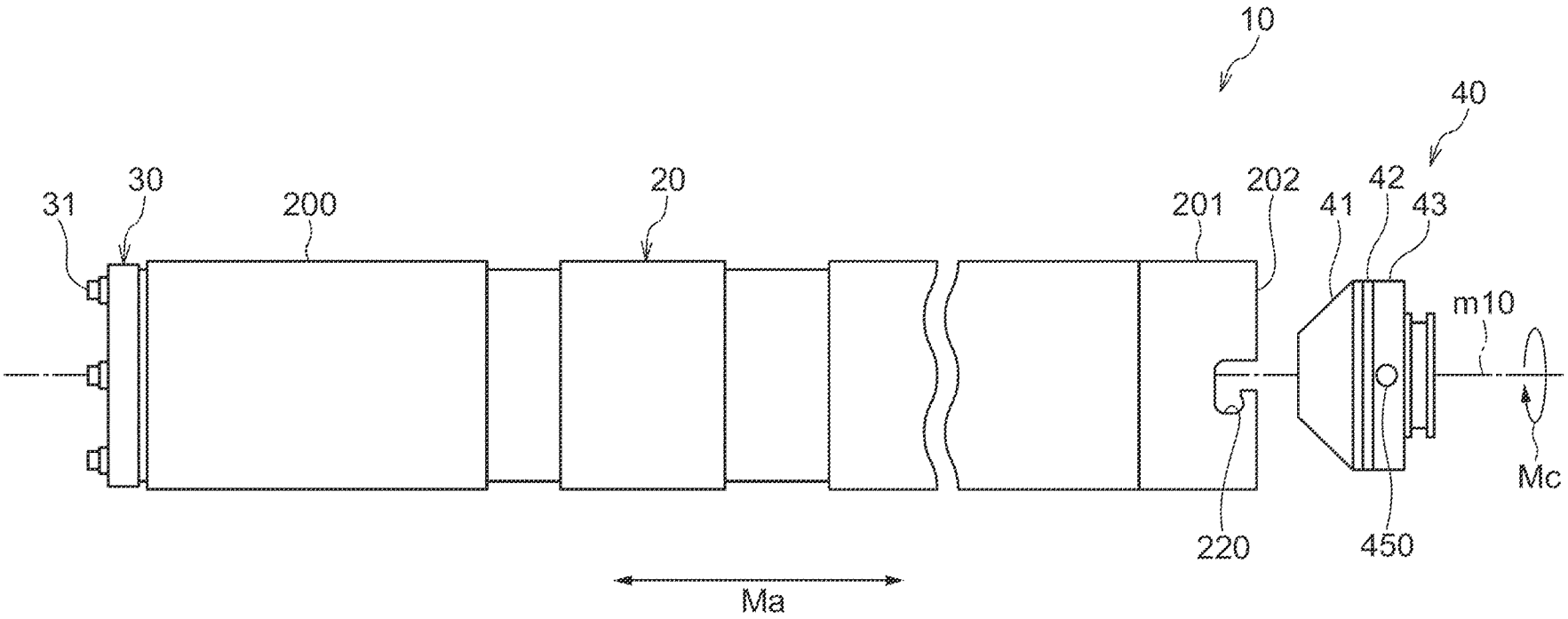
FIG. 14 is a side view illustrating a side surface structure of the mold of the embodiment.

After the processing at step S12 as illustrated in FIG. 13, the attachment-detachment control unit 74 drives the attachment-detachment device 60 to move the hand unit 62 to a position at which the hand unit 62 faces the end face 202 of the mold body 20 to which the lid member 40 is to be attached (step S13). Specifically, the attachment-detachment control unit 74 moves the hand unit 62 to a position illustrated in FIG. 14.

After the processing at step S13 as illustrated in FIG. 13, the image data acquisition unit 71 captures an image of the end face 202 of the mold body 20 with the image capturing device 90 (step S14). Accordingly, the image data acquisition unit 71 acquires image data of the end face 202 of the mold body 20. The plane-directional position detection unit 72 detects the position of the mold body 20 relative to the hand unit 62 based on the image data acquired by the image data acquisition unit 71.

Figure 15:
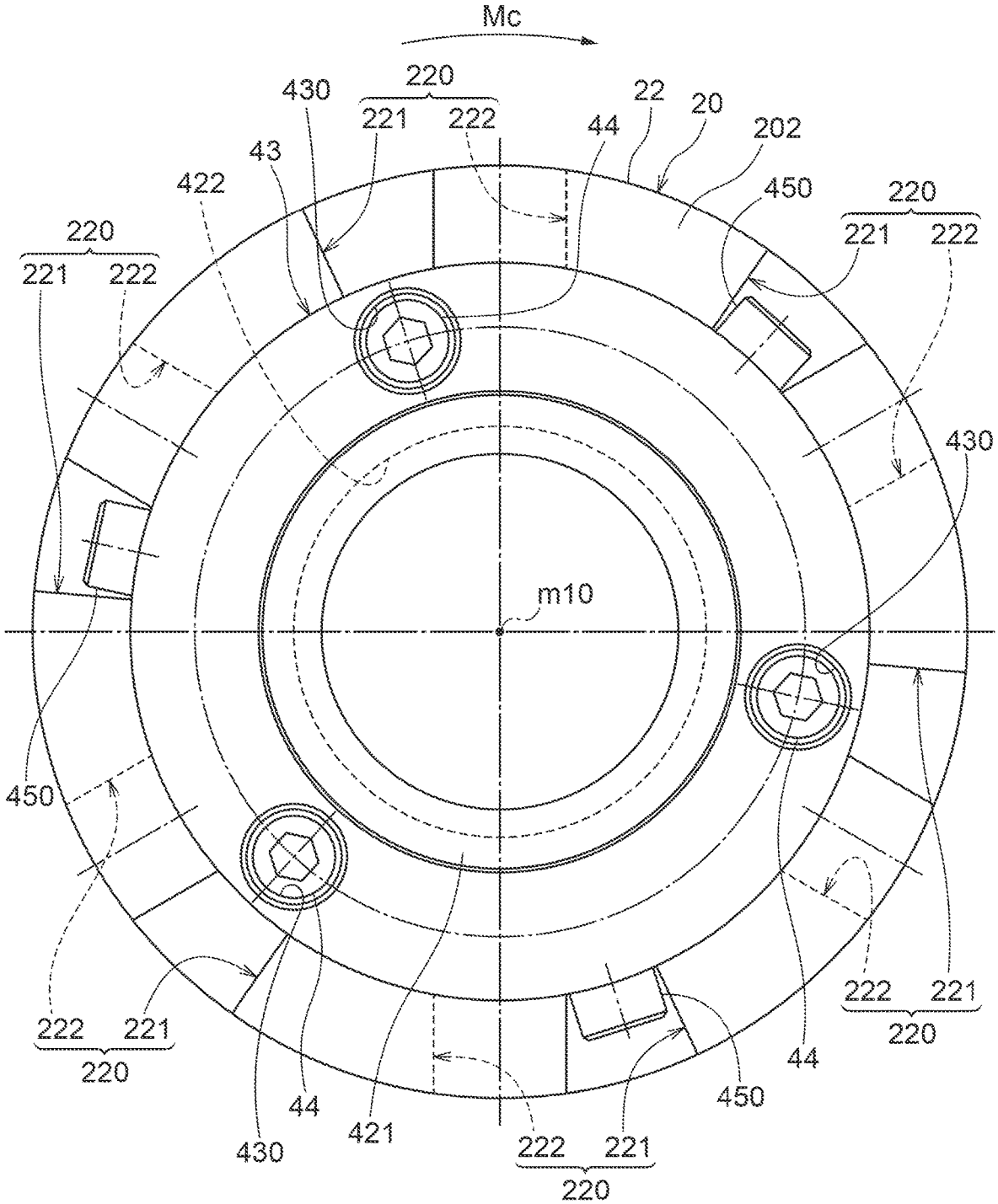
FIG. 15 is an end face diagram illustrating an end face structure of the mold of the embodiment.

After step S14, the attachment-detachment control unit 74 moves the lid member 40 closer to the mold body 20 by driving the arm unit 61 of the attachment-detachment device 60 based on the position of the mold body 20 detected by the plane-directional position detection unit 72, more specifically, driving the arm unit 61 about the first axis L1 to the fifth axis L5 except for the sixth axis L6 (step S15). In this case, the attachment-detachment control unit 74 detects the positions of the groove parts 220 of the mold body 20 relative to the hand unit 62, in other words, the positions of the groove parts 220 of the mold body 20 relative to the lid member 40 in a rotational direction centered at the sixth axis L6 based on the image data of the end face 202 of the mold body 20 acquired by the image data acquisition unit 71. The attachment-detachment control unit 74 rotates the hand unit 62 about the sixth axis L6 so that the detected relative rotational position of the end face 202 of the mold body 20 reaches a predetermined rotational position. The predetermined rotational position is a position where the protrusion parts 450 of the lid member 40 face the first extending parts 221 of the groove parts 220 of the mold body 20 as illustrated in FIG. 15. In the processing at step S15, the attachment-detachment control unit 74 moves the lid member 40 closer to the mold body 20 while maintaining a state in which the lid member 40 has a positional relation with the mold body 20 as illustrated in FIG. 15. Accordingly, the protrusion parts 450 of the lid member 40 are inserted into the first extending parts 221 of the groove parts 220 of the mold body 20.

After the processing at step S15 as illustrated in FIG. 13, the attachment-detachment control unit 74 drives the arm unit 61 to further move the lid member 40 toward the mold body 20 at low speed (step S16). In addition, the depth-directional position detection unit 73 determines whether the output signal from the position sensor 100 has switched to the on-state (step S17). The attachment-detachment control unit 74 continuously moves the lid member 40 toward the mold body 20 at low speed for a duration in which the determination in the processing at step S17 is negative, in other words, a duration in which the output signal from the position sensor 100 is in the off-state.

Thereafter, when the output signal from the position sensor 100 switches from the off-state to the on-state, in other words, when the contact part 101 of the position sensor 100 moves to a position where the contact part 101 contacts the mold body 20, the depth-directional position detection unit 73 performs positive determination in the processing at step S17. In this case, the attachment-detachment control unit 74 drives the arm unit 61 to rotate the hand unit 62 about the sixth axis L6 (step S18) so that the protrusion parts 450 of the lid member 40 are inserted and fitted into the second extending parts 222 of the groove parts 220 of the mold body 20.

Subsequently, the assembly determination unit 75 determines whether the protrusion parts 450 of the lid member 40 are normally assembled to the groove parts 220 of the mold body 20 (step S19). The assembly determination unit 75 requests the image data acquisition unit 71 to acquire image data of the end face 202 of the mold body 20. The image data acquisition unit 71 captures an image of the end face 202 of the mold body 20 with the image capturing device 90 based on the request from the attachment-detachment control unit 74 and transmits image data of the image to the assembly determination unit 75. Accordingly, the assembly determination unit 75 can obtain, for example, such image data illustrated in FIG. 16 that the protrusion parts 450 of the lid member 40 is assembled to the second extending parts 222 of the groove parts 220 of the mold body 20. The assembly determination unit 75 determines whether the protrusion parts 450 of the lid member 40 are normally assembled to the groove parts 220 of the mold body 20 based on the image data. For example, the assembly determination unit 75 acquires the positions of the groove parts 220 of the mold body 20 and the positions of the stepped bolts 44 of the lid member 40 from the image data and determines whether the protrusion parts 450 of the lid member 40 are normally assembled to the groove parts 220 of the mold body 20 based on their relative positional relation.

Figure 16:
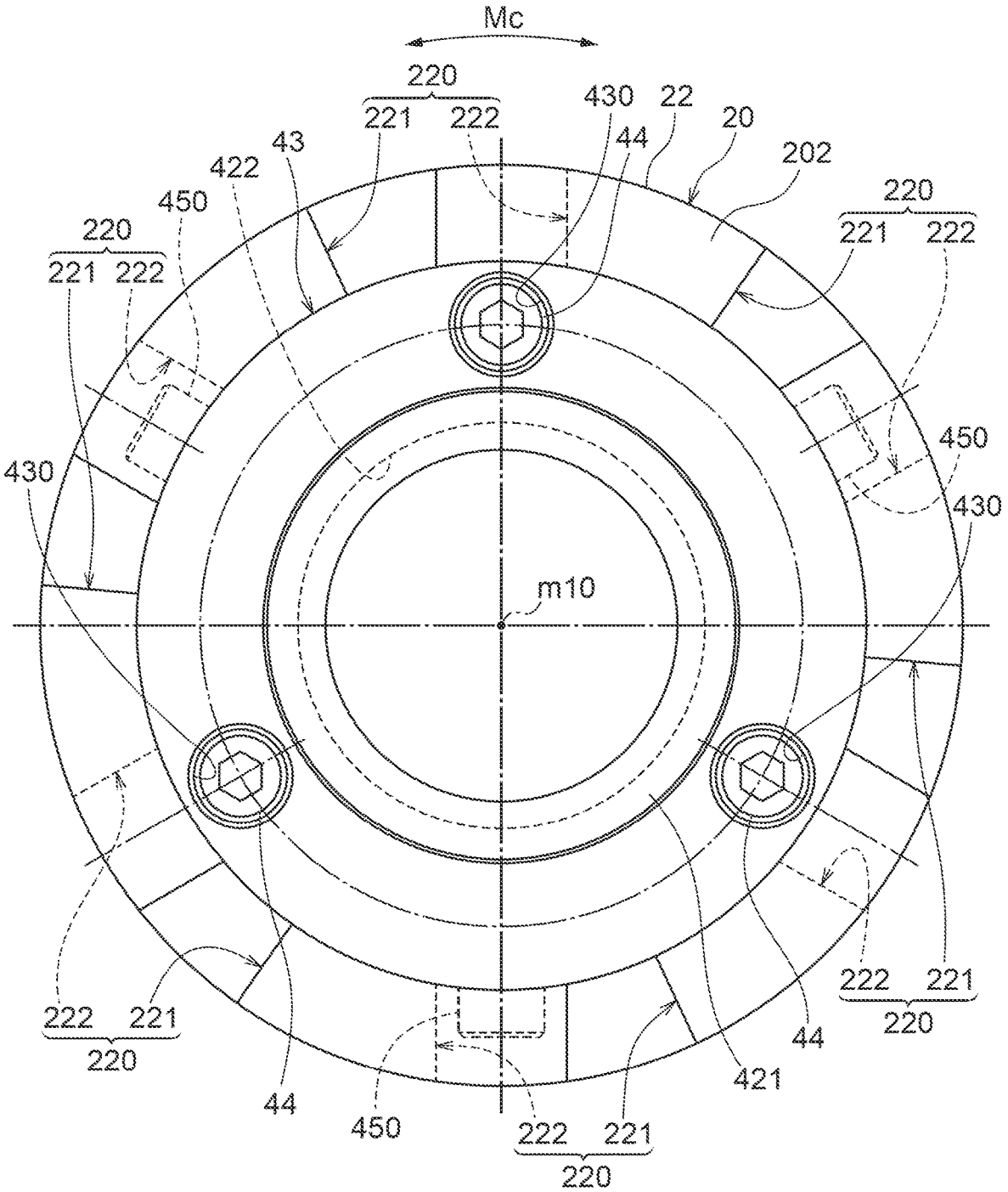
FIG. 16 is an end face diagram illustrating an end face structure of the mold of the embodiment.

When the positional relation of the groove parts 220 of the mold body 20 and the stepped bolts 44 of the lid member 40 is a positional relation as illustrated in FIG. 16, the assembly determination unit 75 determines that the protrusion parts 450 of the lid member 40 are normally assembled to the groove parts 220 of the mold body 20. In other words, when image data as illustrated in FIG. 16 can be acquired, the assembly determination unit 75 performs positive determination in the processing at step S19 illustrated in FIG. 13. In this case, the attachment-detachment control unit 74 cancels the grasping of the lid member 40 by the hand unit 62 (step S20). In this process, the attachment-detachment control unit 74 cancels the pressing force applied to the movable ring 43 of the lid member 40 by the pressing mechanism 80. Accordingly, the elastic force of the springs 46 is applied as force in the direction in which the lid body 41 of the lid member 40 separates from the stopper ring 22 in the axial direction Ma, and thus a state in which the protrusion parts 450 of the lid member 40 are fitted to the groove parts 220 of the stopper ring 22 and a state in which the tilt surface 412 of the lid member 40 closely contacts the tapered surface 211 of the inner periphery of the mold body 20 are achieved and held as illustrated in FIG. 9. Thereafter, as illustrated in FIG. 13, the attachment-detachment control unit 74 drives the arm unit 61 to retract the hand unit 62 to a predetermined standby position (step S21), and then ends the series of processes illustrated in FIG. 13.

Figure 17:
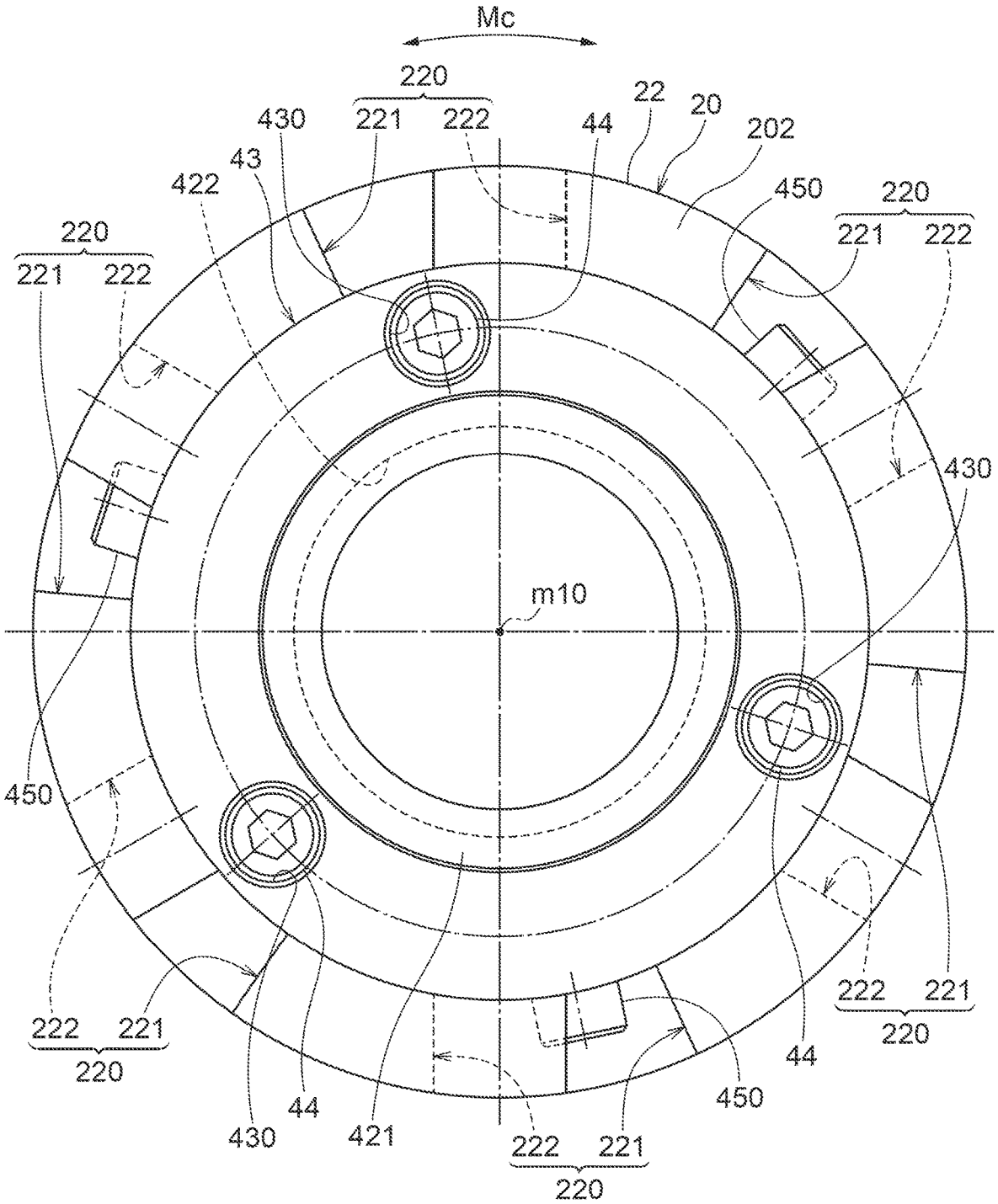
FIG. 17 is an end face diagram illustrating an end face structure of the mold of the embodiment.

Consider a case in which image data as illustrated in FIG. 17 is acquired by the assembly determination unit 75 in the processing at step S19. A positional relation obtained from the image data illustrated in FIG. 17 for the groove parts 220 of the mold body 20 and the stepped bolts 44 of the lid member 40 is different from the positional relation in a normal case illustrated in FIG. 16. Thus, the assembly determination unit 75 determines that the protrusion parts 450 of the lid member 40 are not normally assembled to the groove parts 220 of the mold body 20, and performs negative determination in the processing at step S19 illustrated in FIG. 13. In this case, the anomaly processing unit 76 issues an alert or the like from the notification unit 63 of the attachment-detachment device 60 (step S22) and stops the attachment-detachment device 60 at the origin of the arm unit 61 (step S23).

After the lid member 40 is attached to the mold body 20 through the processing illustrated in FIG. 13, a process of pouring molten metal from the molten metal supply furnace into the mold body 20 and a process of cooling the mold body 20 to solidify the molten metal and shape a cast are sequentially performed on the production line. Thereafter, a process of detaching the lid member 40 from the mold body 20 is performed to remove the cast from the mold body 20.

The procedure of processing of detaching the lid member 40 executed by the control device 70 will be described below with reference to FIG. 18. Note that the control device 70 starts processing illustrated in FIG. 18 based on reception of an instruction for detachment of the lid member 40 from the mold body 20, which is transmitted from the manufacturing management device 110.

Figure 18:
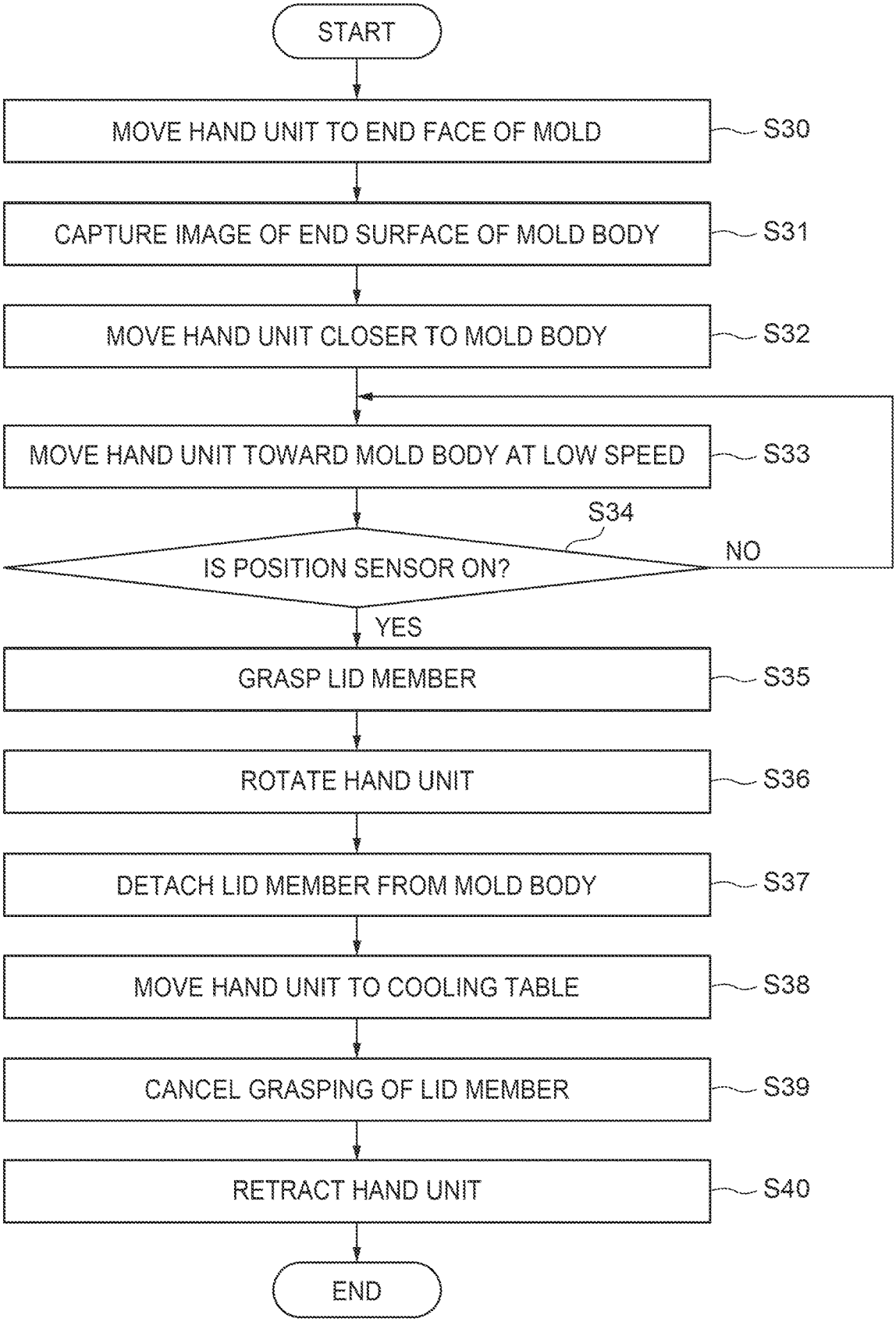
FIG. 18 is a flowchart illustrating the procedure of processing executed by the control device of the embodiment.

As illustrated in FIG. 18, the control device 70 first executes processing at steps S30 to S34 to move the hand unit 62 closer to the mold body 20. Note that the processing at steps S30 to S34 is similar to the processing at steps S13 to S17 illustrated in FIG. 13 except that the lid member 40 is not grasped by the hand unit 62, and thus detailed description of the processing is omitted.

When positive determination is performed in the processing at step S34, in other words, when the contact part 101 of the position sensor 100 moves to a position where the contact part 101 contacts the mold body 20, the attachment-detachment control unit 74 grasps the lid member 40 with the hand unit 62 by driving the hand unit 62 so that the first click part 621 and the second click part 622 are closed (step S35). In this case, after grasping the lid member 40 with the hand unit 62, the attachment-detachment control unit 74 drives the pressing mechanism 80 of the hand unit 62 to apply pressing force to the movable ring 43 of the lid member 40 so that the movable ring 43 is pressed toward the flange part 42 against elastic force of the springs 46. Accordingly, the movable ring 43 of the lid member 40 closely contacts the flange part 42 and fitting of the protrusion parts 450 of the lid member 40 to the groove parts 220 of the mold body 20 is canceled.

After the processing at step S35, the attachment-detachment control unit 74 drives the arm unit 61 to rotate the hand unit 62 about the sixth axis L6 (step S36) so that the protrusion parts 450 of the lid member 40 move to the first extending parts 221 of the groove parts 220 of the mold body 20. Thereafter, the attachment-detachment control unit 74 detaches the lid member 40 from the mold body 20 by further driving the arm unit 61 to move the hand unit 62 in the Hx2 direction illustrated in FIG. 11 (step S37).

After the processing at step S37, the attachment-detachment control unit 74 drives the arm unit 61 based on coordinate data to move the hand unit 62 to the cooling table (step S38). Then, the attachment-detachment control unit 74 cancels the grasping of the lid member 40 by the hand unit 62 (step S39), and then drives the arm unit 61 to retract the hand unit 62 to the predetermined standby position (step S40) and ends the series of processes illustrated in FIG. 18.

According to the mold 10 and the assembly device 50 of the present embodiment described above, it is possible to obtain operations and effects listed at (1) to (9) below.

(1) The lid member 40 includes the lid body 41 that is attached to the opening part formed at the end part 201 of the mold body 20, each protrusion part 450 as the fitting part that is fitted to the mold body 20, and each spring 46 as the elastic force application part that applies elastic force to the lid body 41 in a direction in which the lid body 41 closely contacts the mold body 20. With this configuration, the lid body 41 can closely contact the mold body 20 with the elastic force of the springs 46, and thus the lid member 40 can more reliably closely contact the mold body 20 than in a case of a conventional mold in which the lid member is mounted on the mold body by using a screw fastening structure.

(2) As illustrated in FIG. 9, each protrusion part 450 protruding outward is formed on the outer peripheral surface of the lid member 40. Each groove part 220 into which the protrusion part 450 of the lid member 40 is inserted is formed at the end part 201 of the mold body 20. The protrusion part 450 of the lid member 40 is fitted to the groove part 220 of the mold body 20. With this configuration, a fitting structure of the mold body 20 and the lid member 40 can be easily achieved.

(3) As illustrated in FIG. 2, each groove part 220 includes the first extending part 221 having an opening part at the end face 202 of the mold body 20 and formed to extend in the axial direction Ma of the mold body 20, and the second extending part 222 formed to extend in the circumferential direction Mc of the mold body 20 from an end part opposite to the opening part of the first extending part 221. As illustrated in FIG. 9, the lid member 40 further includes the movable ring 43 including the protrusion part 450. The movable ring 43 is formed separately from the lid body 41 and can be displaced relative to the lid body 41 in the axial direction Ma. The protrusion part 450 of the lid member 40 is fitted to the second extending part 222 of the groove part 220. Each spring 46 illustrated in FIG. 8 applies elastic force to the lid body 41 and the movable ring 43 in a direction in which the lid body 41 separates from the movable ring 43 in the axial direction Ma. The mold 10 has a mechanism that the lid body 41 closely contacts the mold body 20 with the elastic force applied to the lid body 41 by the spring 46 and the protrusion part 450 is pressed to the inner wall surface 222*b* of the second extending part 222 of the groove part 220 with the elastic force applied to the movable ring 43 by the spring 46. With this configuration, the protrusion part 450 is unlikely to be come off the second extending part 222 of the groove part 220 because of the elastic force applied to the movable ring 43 by the spring 46. As a result, the lid member 40 is unlikely to fall off the mold body 20.

Note that the second extending part 222 preferably extends in a direction opposite to a direction in which the mold 10 rotates in centrifugal casting. Accordingly, the protrusion part 450 is unlikely to be come off the second extending part 222 when the mold 10 rotates, and as a result, the lid member 40 is unlikely to fall off the mold 10.

(4) As illustrated in FIGS. 2 and 9, each concave part 222*c* into which the protrusion part 450 is inserted is formed at the inner wall surface 222*b* of the second extending part 222 of the groove part 220 that the protrusion part 450 of the movable ring 43 contacts. With this configuration, even when the protrusion part 450 of the lid member 40 is displaced in a direction in which the protrusion part 450 comes off the second extending part 222, the protrusion part 450 is prevented from coming off because the protrusion part 450 is unlikely to come off the concave part 222*c*. Thus, the lid member 40 is more unlikely to fall off the mold body 20.

(5) As illustrated in FIGS. 3 and 5, the number of the groove parts 220 of the mold body 20 is larger than the number of the protrusion parts 450 of the lid member 40. With this configuration, the number of groove parts 220 into which the protrusion part 450 can be inserted is larger than in a case in which the number of the protrusion parts 450 and the number of the groove parts 220 are equal to each other. As a result, the lid member 40 can be easily assembled to the mold body 20.

(6) When attaching the lid member 40 to the mold body 20, the control device 70 grasps the lid member 40 with the hand unit 62 of the attachment-detachment device 60 and then captures an image of the end face 202 of the mold body 20 with the image capturing device 90 and detects the position of the mold body 20 relative to the hand unit 62 based on image data obtained by the image capturing. Then, the control device 70 fits each protrusion part 450 of the lid member 40 to the mold body 20 by displacing the hand unit 62 based on the detected position of the mold body 20. With this configuration, work of attaching the lid member 40 to the mold body 20 can be automatically performed by the attachment-detachment device 60, and thus convenience can be improved.

(7) The attachment-detachment device 60 further includes the position sensor 100 configured to detect the position of the hand unit 62 relative to the mold body 20 in the axial direction Ma. The control device 70 fits each protrusion part 450 of the lid member 40 to the mold body 20 by further displacing the hand unit 62 based on the position of the hand unit 62 detected by the position sensor 100. With this configuration, the hand unit 62 can be more accurately displaced, and thus the lid member 40 can be more accurately attached to the mold body 20.

(8) The control device 70 displaces the hand unit 62 in a direction in which each protrusion part 450 of the lid member 40 is fitted to the mold body 20, and then captures an image of the end face 202 of the mold body 20 with the image capturing device 90 and determines whether each protrusion part 450 of the lid member 40 is fitted to the mold body 20 based on image data obtained by the image capturing. Then, the control device 70 determines that the attachment of the lid member 40 to the mold body 20 is normally performed when having determined each protrusion part 450 of the lid member 40 is fitted to the mold body 20. With this configuration, whether the process of attaching the lid member 40 to the mold body 20 is normally performed can be accurately detected.

(9) When detaching the lid member 40 from the mold body 20, the control device 70 captures an image of the end face 202 of the mold body 20 with the image capturing device 90 and detects the position of the mold body 20 relative to the hand unit 62 based on image data obtained by the image capturing. Then, the control device 70 grasps the lid member 40 with the hand unit 62 by displacing the hand unit 62 based on the detected position of the mold body 20, and then cancels a state in which each protrusion part 450 of the lid member 40 is fitted to the mold body 20 by further displacing the hand unit 62. With this configuration, work of detaching the lid member 40 from the mold body 20 can be automatically performed by the attachment-detachment device 60, and thus convenience can be improved.

Note that the above-described embodiment may be performed forms described below.

The shape of each groove part 220 formed at the mold body 20 is changeable as appropriate to an optional shape such as a V shape as long as each protrusion part 450 of the lid member 40 can be fitted to the groove part 220. Alternatively, the shape of each groove part 220 may be, for example, the shape of a slit having a cutout or the shape of a groove having a concave part. In this manner, the definition of each groove part of the present embodiment includes a slit and a recess.

The number of the protrusion parts 450 of the lid member 40 and the number of the groove parts 220 of the mold body 20 may be equal to each other.

The fitting structure for assembling the lid member 40 to the mold body 20 is changeable as appropriate. For example, a protrusion part may be provided at the mold body 20, a groove part into which the protrusion part is inserted may be provided at the lid member 40, and the lid member 40 may be assembled to the mold body 20 by fitting the protrusion part of the mold body 20 to the groove part of the lid member 40.

The process of attaching the lid member 40 to the mold body 20 may be performed by a worker with a hand without using the attachment-detachment device 60.

The present disclosure is not limited to the above-described specific examples. Those obtained by adding designing change to the above-described specific examples as appropriate by the skilled person in the art are also included in the scope of the present disclosure as long as they have the features of the present disclosure. Elements included in the above-described specific examples, and their disposition, conditions, shapes, and the like are not limited to those exemplarily described but may be changed as appropriate. Combination of elements included in the above-described specific examples may be changed as appropriate without technological inconsistency.

What is claimed is:

1. A centrifugal casting mold used for centrifugal casting and including a mold body and a lid member, the mold body being formed in a cylindrical shape, the lid member being detachably assembled to an end part of the mold body in an axial direction, wherein the lid member includes a lid body that is attached to an opening part formed at an end part of the mold body, a fitting part that is fitted to the mold body, and an elastic force application part that applies elastic force to the lid body in a direction in which the lid body closely contacts the mold body, wherein a protrusion part protruding outward is formed as the fitting part on an outer peripheral surface of the lid member, a groove part into which the protrusion part of the lid member is inserted is formed at an end part of the mold body, the protrusion part of the lid member is fitted to the groove part of the mold body, and wherein the groove part includes a first extending part and a second extending part, the first extending part having an opening part at an end face of the mold body and formed to extend in a direction parallel to an axial direction of the mold body, the second extending part being formed to extend in a circumferential direction of the mold body from an end part opposite to the opening part of the first extending part, the lid member further includes a movable member including the fitting part, the movable member is formed separately from the lid body and can be displaced relative to the lid body in the axial direction of the mold body, the protrusion part of the lid member is fitted to the second extending part of the groove part, the elastic force application part applies elastic force to the lid body and the movable member in a direction in which the lid body separates from the movable member in the axial direction of the mold body, and the mold has a mechanism that the lid body closely contacts the mold body with the elastic force applied to the lid body by the elastic force application part and the fitting part is pressed to an inner wall surface of the second extending part by the elastic force applied to the movable member by the elastic force application part.

2. The centrifugal casting mold according to claim 1, wherein a concave part into which the protrusion part is inserted is formed at the inner wall surface of the second extending part that the protrusion part of the movable member contacts.

3. The centrifugal casting mold according to claim 2, wherein a plurality of the protrusion parts is formed on the outer peripheral surface of the lid member, and a plurality of groove parts in a number larger than the number of the protrusion parts are formed at the end part of the mold body.

* * * * *